US012448204B2

(12) United States Patent
Omuta et al.

(10) Patent No.: US 12,448,204 B2
(45) Date of Patent: Oct. 21, 2025

(54) BULK CONTAINER

(71) Applicant: ROKKO ENGINEERING CO., LTD., Kobe (JP)

(72) Inventors: Mamoru Omuta, Kobe (JP); Yukio Hanashiro, Kobe (JP); Yuuya Sekoguchi, Kobe (JP)

(73) Assignee: ROKKO ENGINEERING CO., LTD., Kobe (JP)

( * ) Notice: Subject to any disclaimer, the term of this patent is extended or adjusted under 35 U.S.C. 154(b) by 64 days.

(21) Appl. No.: 18/549,708

(22) PCT Filed: Mar. 4, 2022

(86) PCT No.: PCT/JP2022/009562
§ 371 (c)(1),
(2) Date: Sep. 8, 2023

(87) PCT Pub. No.: WO2022/191089
PCT Pub. Date: Sep. 15, 2022

(65) Prior Publication Data

US 2024/0174434 A1 May 30, 2024

(30) Foreign Application Priority Data

Mar. 12, 2021 (JP) ..... 2021-040822

(51) Int. Cl.
*B65D 88/12* (2006.01)
*B65D 90/58* (2006.01)
*B65D 90/66* (2006.01)

(52) U.S. Cl.
CPC ..... *B65D 88/126* (2013.01); *B65D 90/587* (2013.01); *B65D 90/66* (2013.01); *B65D 2588/54* (2013.01); *B65D 2590/66* (2013.01)

(58) Field of Classification Search
CPC .. B65D 88/127; B65D 88/126; B65D 88/124; B65D 88/122; B65D 88/121;
(Continued)

(56) References Cited

U.S. PATENT DOCUMENTS 6,364,153 B1 * 4/2002 Petzitillo, Jr. ..... B65F 1/16 220/908
2005/0198902 A1 * 9/2005 Meyer ..... B65D 90/66 52/192

(Continued)

FOREIGN PATENT DOCUMENTS

CA 3130876 A1 8/2020
JP S52146372 A 12/1977

(Continued)

OTHER PUBLICATIONS

Extended European Search Report cited in corresponding Appln. No. 22767045.2 dated Jan. 28, 2025.

*Primary Examiner* — Robert J Hicks
(74) *Attorney, Agent, or Firm* — BACON & THOMAS.PLLC

(57) ABSTRACT

A charging port 5 in an upper part is covered in an openable and closeable manner with a lid body 6 of a sliding door type (sliding type) that reciprocates horizontally. The lid body 6 reciprocates in conjunction with a movement of an operation member 50 provided in a side part of a container vessel 3 or at a location close to the side part. It is preferable that the charging port 5 includes an opening that is long along a length direction of the container vessel 3, and the lid body 6 reciprocates horizontally in a width direction of the container vessel 3 to open and close the charging port 5.

10 Claims, 17 Drawing Sheets

(58) Field of Classification Search
CPC ..... B65D 88/12; B65D 90/587; B65D 90/58; B65D 90/66; B65D 90/54; B65D 43/20; B65D 43/12; B65D 2588/54; B65D 2590/66; B65D 2590/54
USPC ..... 220/1.5, 812, 811, 345.4, 345.2, 345.1; 105/282.1
See application file for complete search history.

(56) References Cited

U.S. PATENT DOCUMENTS

| | | | | |
|---|---|---|---|---|
| 2021/0046955 | A1 | 2/2021 | Jones et al. | |
| 2021/0107845 | A1* | 4/2021 | Buzruk | B65D 43/20 |
| 2022/0041369 | A1* | 2/2022 | Corrigan | B65D 90/66 |

FOREIGN PATENT DOCUMENTS

| | | | |
|---|---|---|---|
| JP | H0321430 | B2 | 3/1991 |
| JP | 3030391 | U | 10/1996 |
| JP | 3204506 | U | 6/2016 |
| JP | 2019064675 | A | 4/2019 |
| JP | 2021020689 | A | 2/2021 |
| WO | WO2012/120451 | A1 | 9/2012 |

* cited by examiner

BULK CONTAINER

TECHNICAL FIELD

The present invention relates to a so-called bulk container used for storing and transporting cargo in a powdery or granular state such as wood pellets and grains.

BACKGROUND ART

Bulk containers are containers used for purposes such as receiving cargo in a powdery or granular state such as wood pellets from a charging port in an upper part (top portion) of the container to store the cargo, and may be loaded onto a truck or the like and transported in this state, and then, the cargo may be discharged from a discharging port provided in a part of a side wall or the like. For example, from a hopper provided at a seaport, wood pellets and the like are charged through a charging port into a bulk container (into a container vessel), and then, discharged by opening a discharging port and tilting the container.

Needless to say, a door that can be freely opened and closed is provided in the discharging port, and a cover for preventing rainwater and the like from entering the container is also provided in the charging port in the upper part of the container. As the cover of the charging port, a hinged type (rotary type) door such as a hatch is usually provided. By using the hinged type door, it is easier to arrange a packing or the like for preventing rainwater from entering the container.

PTL 1 mentioned below describes a container in which a sliding door type (slidably openable/closeable type) cover is provided in a charging port in an upper part of the container. Further, PTL 2 discloses a configuration in which a sliding door type cover is provided in an upper opening of a container in which a liquid is placed, as a cover for opening and closing the upper opening. PTL 2 indicates that a sliding door type cover is more advantageous than a hinged door type cover, in a case where it is not possible to secure a space between the cover and the hopper above the cover.

CITATION LIST

Patent Literature

PTL 1: Japanese Patent Kokoku Publication No. H3-21430
PTL 2: Japanese Utility Model Registration No. 3204506

SUMMARY OF INVENTION

Technical Problem

Bulk containers are generally charged with powdery or granular cargo from above by using a hopper. In order to prevent the cargo from scattering, the height of a charging port of the bulk container transported below the hopper by a truck or the like needs to be close to the height of a lower end part of the hopper. Therefore, in a situation where a bulk container loaded onto a truck or the like is transported to a location directly below the hopper, and then the charging port is opened to receive the cargo, as described in PTL 1 and 2, a bulk container of a sliding door type in which a lid of the charging port slides horizontally is more advantageous than a bulk container of a hinged door type in which a door rotates upward. If a hinged type door is attached to the charging port, it is necessary to adopt the following procedure. First, the truck is stopped in front of the hopper and the door of the bulk container is opened. Subsequently, the truck is advanced to position the charging port directly under the hopper to receive the cargo. After that, the truck is again slightly advanced to shift the position of the charging port from directly under the hopper, and then, the door is closed. On the other hand, if a lid of a sliding door type is attached to the charging port, it is not necessary to stop the truck in front of the hopper and at a position slightly past the hopper.

However, in the examples of PTL 1 and 2, a worker (or a truck driver) needs to climb to an upper part of the vessel in order to open and close the cover of the charging port. This is because the lid used as a cover is opened and closed by operating the lid directly by hand.

Further, PTL 1 and 2 do not illustrate an example in which the charging port is sufficiently long in a length direction of the container. Powdery or granular cargo charged from a hopper or the like accumulates in a container vessel by forming a cone-shaped mountain having an inclination equal to the repose angle of the powdery or granular cargo. Therefore, if the bulk container only includes a charging port at or in the vicinity of a center part of the bulk container, a large portion that is not filled with cargo remains in an upper internal space corresponding to the front and rear of the container vessel in the length direction. This problem can also be solved by providing a plurality of charging ports in the length direction of the container. However, the increased number of charging ports increases the burden on workers who climb to the upper part of the container to open and close the cover.

In consideration of the above points, the present invention provides a preferred bulk container by which a worker can open and close a cover of a charging port without climbing to the upper part of the container, and by which it is possible to reduce the space that is not filled with powdery or granular cargo.

Solution to Problem

The invention of the present application is a bulk container for receiving cargo in a powdery or granular state charged into a container vessel (referring to a box-shaped portion as a container) from a charging port provided in an upper part of the bulk container, and the bulk container is characterized in that

- the charging port is covered with a lid body of a sliding door type (sliding type) that reciprocates horizontally (including a substantially horizontal direction) to open and close the charging port, and
- the lid body reciprocates as described above in conjunction with a movement of an operation member provided in a side part of the container vessel.

The bulk container includes the lid body of the sliding door type that moves horizontally, in the charging port at the upper part of the bulk container. Therefore, as described above, when transporting the bulk container to a location directly below a supply device such as a hopper and receiving powdery or granular cargo charged from the charging port, it is possible to open and close the lid body at a position directly below the hopper, near a lower end opening of the hopper. Moreover, the lid body reciprocates in conjunction with the movement of the operation member provided in the side part of the container vessel. Therefore, a worker can open and close the charging port by moving the operation member in the side part of the container vessel, without climbing to the upper part of the container. From these points, according to the bulk container of the invention, it is possible to efficiently and safely receive cargo from a hopper or the like.

In the bulk container according to the invention described above, it is preferable that the charging port has an opening having a rectangular shape that is long in a length direction of the container vessel (a direction along a long side of a horizontal dimension of the container) (that is, the opening is longer in the length direction of the vessel than in a width direction of the container vessel), and the lid body is configured to move horizontally (including a substantially horizontal direction) by a reciprocating movement in a width direction of the container vessel to open and close the charging port, and the lid body includes one plate which can wholly cover the charging port, or includes two plates which can wholly cover the charging port by bringing opposing edge parts of the two plates close to each other until the opposing edge parts abut against each other (and which opens the charging port when two plates are moved so that the edge parts are moved away from each other).

If the charging port is long in the length direction of the container vessel as described above, that is, is a so-called longitudinally long charging port, the container vessel can receive powdery or granular cargo charged from a hopper or the like, not only at or in the vicinity of a center part of the container vessel, but also at or in the vicinity of both end parts of the container vessel in the length direction. Therefore, the cargo that accumulates in the container vessel by forming an inclined surface of a repose angle can also be received in front and rear portions of the container vessel in the length direction until the cargo reaches an upper part of the container vessel. This makes it possible to effectively utilize the space inside the container vessel and charge a large amount of cargo.

When the charging port is longitudinally long as described above, the lid body covering the charging port preferably reciprocates in the width direction of the container vessel to open and close the charging port as described above. The charging port is longitudinally long, and thus, if the lid body covering the charging port reciprocates in the length direction of the container vessel, there is a risk that the lid body significantly protrudes from the container vessel to the front or rear (to one side in the length direction of the vessel) when the charging port is opened. If the lid body protrudes significantly from the container vessel, the lid body may contact a part of a truck onto which the container vessel is loaded or a nearby facility or machine, which may hinder the smooth charging of cargo. If the lid body is configured so as to reciprocate in the width direction of the container vessel, the above-described disadvantages are less likely to occur, even when the charging port is longitudinally long. Further, if the lid body is formed by the one or two plates described above, the lid body can cover the charging port to prevent rainwater from entering the container vessel.

In the bulk container in which the charging port is covered by the lid body of a sliding door type, as described above, and the lid body reciprocates in conjunction with the operation member in the side part of the bulk container, it is preferable that the lid body is movable along guide tracks provided in the vicinity of both end parts of the charging port in the length direction, and the lid body is coupled to the operation member via a transmission mechanism including a cord body (such as a wire rope, a rope, and a string) passed through a side part and an upper part of the container vessel and a pulley on which the cord body is hooked, so that the lid body reciprocates as described above in conjunction with the operation member.

An example of a bulk container having such a configuration is illustrated in FIGS. 1A, 1B and FIG. 3 and the like. A lid body 6 that is movable along guide tracks 14 is coupled to an operation member 20 via a transmission mechanism 10 including wire ropes 11 and pulleys 12 and 12*a*.

The lid body is movable along the guide tracks, and thus, the lid body can open and close the charging port by reciprocating, as described above, within a constant range in which the lid body can cover the charging port, in the upper part of the container vessel. Further, the lid body is coupled to the operation member by the transmission mechanism including the cord body and the pulley. Therefore, when the operation member provided in a side portion of the container vessel at a position separated from the lid body is moved, the lid body reciprocates in conjunction with the operation member, as described above. If the transmission mechanism including the cord body and the pulley is used, restrictions on the movement direction of the lid body and the position and the movement direction of the operation member that moves in conjunction with the lid body are reduced. Therefore, a bulk container that is convenient to use can be realized.

In the bulk container described above in which the cord body or the like is used, it is particularly preferable that the operation member is provided only on one side wall surface of the container vessel, and the arrangement of the pulley and the cord body of the transmission mechanism is determined so that the force that is exerted when the operation member is moved is transmitted, as a force causing the lid body to reciprocate, to two locations on the lid body separated in a direction perpendicular to the movement direction of the lid body, via the cord body.

This configuration is also employed in a bulk container 1 illustrated in FIG. 3. When tensile force is applied to one of the wire ropes 11 by the operation member 20, the movable pulleys 12*a* located at two separate positions are simultaneously pulled downward in the drawing to move the lid body 6.

If the operation member provided in the side part of the container vessel is provided on each of the two side wall surfaces that are opposite to each other, it is advantageous for causing the lid body to reliably reciprocate (that is, causing the charging port to open and close). This is because, even if the lid body is a long lid body or the lid body does not move smoothly along the guide tracks, the lid body can be easily moved by simultaneously operating and moving the operation members on the two side wall surfaces. However, two workers are required to simultaneously operate the operation members provided on the two side wall surfaces spaced from each other.

In this regard, in the bulk container described above, the operation member is provided only on one side wall surface of the container vessel, and thus, even one worker can cause the lid body to reciprocate. Further, the force that moves the operation member is transmitted, via the cord body, to two locations on the lid body which are separated from each other in a direction perpendicular to the movement direction of the lid body. Therefore, when the operation member is moved, the two locations on the lid body are pulled by the cord body to move the lid body. Accordingly, even if one worker moves the operation member placed on one side wall surface of the container vessel, it is possible to reliably move the lid body, similarly to the case where the operation members are provided on the two side wall surfaces opposite to each other.

In the bulk container described above, it is even more preferable that when the charging port is closed by the lid body, a tip end edge part of the lid body (an edge part on the side to which the lid body is moved when the charging port is being closed) and an opening edge part of the charging port abut against each other, or opposing tip end edge parts of the two plates of the lid body abut against each other, and between the tip end edge part of the lid body and the opening edge part of the charging port that abut against each other, or between opposing tip end edge parts of the two plates of the lid body, an elastic packing is attached to one edge part and a metal member is provided on the other edge part (of the other plate that abuts against the one edge part) to be pressed against an end surface of the elastic packing in a horizontal direction.

FIG. 5 illustrates an example of a configuration including the elastic packing, the metal member, and the two edge parts that abut against each other as described above. Reference numeral 31*a* denotes the elastic packing, and reference numeral 31*b* denotes the metal member pressed against the elastic packing 31*a*.

In the bulk container configured as described above, it is possible to effectively prevent rainwater from entering when the charging port is closed by the lid body. The reason is described below. That is, 1) in the bulk container described above, the transmission mechanism is configured so that the force that moves the operation member is transmitted to two locations on the lid body via the cord body. When the operation member is moved, the force is applied to the two locations on the lid body and moves the lid body until the tip end edge part of the lid body and the opening edge part of the charging port abut against each other, or the tip end edge parts of the two plates forming the lid body abut against each other. 2) The force is applied to the two locations, so that the lid body moves reliably, and the force by which the edge parts are butted against each other acts with even strength over the entire length of each edge part. 3) Between the edge parts to be butted against each other, the elastic packing is attached to one edge part and the metal member is provided in the other edge part. Therefore, when the edge parts abut against each other, the metal member is pressed strongly and evenly against the elastic packing over the entire length of the edge parts, so that the metal member is in close contact with the elastic packing, and as a result, a path where rainwater may enter is blocked. If the movement of the lid body is stopped (locked) in this state, it is possible to continuously prevent rainwater from entering and to continuously prevent water from entering the container vessel.

In the bulk container described above in which the charging port is covered by the lid body of a sliding door type, and the lid body reciprocates in conjunction with the operation member in the side part of the bulk container, it is preferable that the operation member is provided only on one side wall surface of the container vessel, linear guide members are arranged parallel to each other in the vicinity of both end parts of the charging port in the length direction, and each of the guide members is mounted with a moving block incorporating a rolling body (that is, low friction linear guide devices, generally called a linear bush or a linear guide, are provided in parallel to each other at the above-described positions in the upper part of the container vessel), and the lid body is attached to the moving block to be movable and the operation member (extending to the side part of the container vessel) is coupled to a part of the lid body (one end part in the length direction), so that the lid body reciprocates in conjunction with the operation member as described above.

An example of a bulk container having such a configuration is illustrated in FIGS. 6A, 6B and FIG. 8 and the like. A moving block 42 incorporating a rolling body is mounted to a linear guide member 41, and the lid body 6 is attached to the moving block 42. An operation member 50 provided only on one side wall surface is fixed and coupled to a part of the lid body 6 (a frame 6*f*).

In a bulk container having such a configuration, the lid body can smoothly reciprocate by a low-friction movement guide effect realized by the two linear guide members arranged in the vicinity of both end parts of the charging port in the length direction and the moving block incorporating a rolling body mounted to the linear guide members. When the operation member fixed to a part of the lid body is moved, the lid body reciprocates together with the operation member. The operation member is provided only on one side wall surface of the container vessel, and thus, even one worker can cause the lid body to reciprocate.

In this movement, the lid body receives force only from a part of the side where the operation member is coupled. Therefore, when the lid body moves along two typical guide tracks provided at an interval from each other, it is also assumed that non-uniform force due to friction acts and the movement is not necessarily smooth. However, in the bulk container described above, two sets of the low friction linear guide devices including a moving block incorporating a rolling body are used, and thus, the lid body can always move smoothly, even when receiving force from only one side.

In the bulk container in which the low friction linear guide devices are provided in the vicinity of both end parts of the charging port as described above, it is preferable that the lid body is fixedly attached to a moving block mounted to one of the guide members arranged in the vicinity of both end parts of the charging port, and is movably attached to the moving block mounted to the other one of the guide members.

This configuration is also employed in the bulk container illustrated in FIG. 9. The (frame 6*f* of the) lid body 6 is fixed with bolts to one of the moving blocks 42 (on the left side in the drawing). A coupling pin 44 having a bolt shape is attached to the other one of the moving blocks 42 (on the right side in the drawing). The lid body 6 is coupled to the pin 44 with a gap surrounding the pin 44 in the horizontal direction and the up-down direction, and the gap serves as a play.

The linear guide members described above are provided in the vicinity of both end parts of the charging port, and thus, two of the linear guide members are normally arranged parallel to each other at an interval of several meters or more in the upper part of the container vessel. Therefore, the degree of parallelism between the two linear guide members may decrease due to an error when attaching the linear guide members, deformation or thermal expansion of the container vessel, and the like.

However, when the lid body is attached to the moving block in each guide member as described above, smooth reciprocating motion of the lid body can be maintained, even when the degree of parallelism of the guide members is not high. As described above, the lid body can move with respect to the moving block on one of the two guide members (the other one described above), and thus, a deviation in the degree of parallelism is solved without problems by the play and the movement of the lid body along the two guide members is not hindered.

In the bulk container in which the low friction linear guide devices are used and the operation member is provided only on one side as described above, it is further preferable that when the charging port is closed by using the lid body, a tip end edge part of the lid body (an edge part on the side to which the lid body is moved when the charging port is being closed) and an opening edge part of the charging port abut against each other, or opposing tip end edge parts of the two plates of the lid body abut against each other, and a metal member oriented upward is provided in each of the edge parts, a water sealing cover including an elastic packing on a lower surface is attached at or in the vicinity of one of the edge parts, and the water sealing cover is moved by an operation tool provided in a side part of the container vessel to press the elastic packing from above against the metal members oriented upward at both edge parts.

FIG. 10 illustrates an example of a configuration including the water sealing cover and the two edge parts that abut against each other as described above. Reference numeral 61 denotes the water sealing cover. The water sealing cover 61 includes an elastic packing 62 on a lower surface, and the elastic packing 62 is pressed from above against an upper end part of the metal member 63.

By adopting the configuration described above, it is possible to effectively prevent rainwater from entering when the charging port is closed by the lid body. The reason is described below. That is, 1) when the operation member is moved to close the charging port, a force is transmitted to a part of the lid body and moves the lid body until the tip end edge part of the lid body and the opening edge part of the charging port abut against each other, or the tip end edge parts of the two plates forming the lid body abut against each other. 2) By using the low friction linear guide devices, the lid body is translated smoothly and no large gap is formed in an entire space between the edge parts or in a part of the space between the edge parts that abut against each other. However, the operation member is coupled only to a part of the lid body, and thus, on the side of the lid body that is far from the operation member and is less likely to receive the force, it is difficult to completely bring the edge parts into close contact. 3) According to the above-described configuration, each of the edge parts is provided with a metal member oriented upward, and the elastic packing of the water sealing cover is pressed from above against the metal members, and thus, even if a small gap is formed between the two edge parts, rainwater is reliably prevented from entering between the edge parts that abut against each other. 4) The operation for pressing the elastic packing of the water sealing cover against the metal members can be easily performed at the side part of the container vessel by using the operation tool. By stopping (locking) the movement of the lid body and the water sealing cover in a state where the elastic packing is pressed against the metal members, it is possible to continuously prevent rainwater from entering and to continuously prevent water from entering the container vessel.

In a bulk container in which a charging port is provided with an openable and closable lid body of a sliding door type, it is particularly preferable to obtain a configuration in which support rails are attached at a position spanning across the charging port to enable the lid body to reciprocate and to support a weight of the lid body, wheels configured to roll on the support rails are attached to a lower part of the lid body, and the support rails have a shape in which a center part protrudes upward.

The support rails are mounted at a position spanning across the charging port, that is, at a position between the two guide tracks or the linear guide members described above. Further, the lid body reciprocates linearly, and thus, the support rails are provided in parallel with the guide tracks or the guide members described above. Examples of support rails and the like are illustrated in FIG. 4 and FIG. 9. Reference numerals 16 and 46 denote the support rails, and reference numerals 6*a* and 6*g* denote the wheels rolling on the support rails.

If the charging port is a continuous long opening such as a longitudinally long charging port, the center portion of the lid body tends to bend or deform downward, if the guide tracks and the linear guide members are only arranged in the vicinity of the two end parts of the charging port, as described above. In this regard, if a configuration in which the support rails are attached at a position spanning across the charging port as described above and the wheels in the lower part of the lid body are configured to move along the support rails, is employed, it is advantageous in supporting the lid body as a whole and preventing deformation of the lid body.

The support rails are provided at a position spanning across the charging port, and thus, it is inevitable that the powdery or granular cargo charged into the container vessel from the hopper or the like falls on the support rails. However, the support rails that are attached have a shape in which the center part protrudes upward, and thus, there is no risk that the movement of the lid body is hindered due to accumulation or adhesion of powdery or granular material on the rails.

In the bulk container according to the invention, it is preferable that the bulk container includes, at a position directly below the charging port in the container vessel, an inclined plate or an impeller capable of changing a falling direction of the powdery or granular cargo being charged.

FIGS. 11A to 11C illustrate an example in which an inclined plate or an impeller having such a configuration is attached.

If such an inclined plate or impeller is provided directly below the charging port, when powdery or granular cargo is charged into the container vessel from an opening of a hopper or the like, the cargo can be dropped not only directly below the opening, but can also spread to a surrounding area. In general, powdery or granular cargo accumulates in a conical shape having a slope of a repose angle, as mentioned above. Accordingly, if the cargo drops only straight downward from the hopper or the like, a large empty space that cannot be filled with cargo remains in the upper part of the container vessel. However, if the cargo is dropped so as to spread to a surrounding area by the action of the inclined plate or the like, as described above, it is possible to reduce the empty space that cannot be filled with cargo and to effectively utilize the inner space of the container vessel.

Regarding the bulk container described above in which the charging port is covered by the lid body of a sliding door type, and the lid body reciprocates in conjunction with the operation member in the side part of the bulk container, it is also preferable that the operation member described above is provided not in the side part of the container vessel, but at a position in the top portion of the container vessel close to any one side part.

An example of a bulk container having such a configuration is illustrated in FIGS. 12A, 12B and FIG. 14 and the like. An operation member 80 is provided at a position in the top portion of the container vessel 3 close to a side part corresponding to one end part in the length direction. When the operation member 80 is moved in the width direction of the container vessel 3, the lid body 6 is also moved in the same direction, and thus, a charging port 5 can be opened and closed.

If the operation member used for reciprocating the lid body is provided in a side part of the container vessel as described above (on a side surface of an end part in the length direction or on another side surface of the vessel), it is easy to perform the operation. Moreover, even when the operation member is provided at a position close to one of the side parts of the top portion of the container vessel, the operation can be easily performed. This is because, if a simple work platform from which the one of the side parts is accessible is prepared for the operation member provided at the position close to the one of the side parts, a worker can utilize the platform to perform the operation, and the worker does not need to climb to the top portion of the container vessel.

In the bulk container, the lid body covering the charging port so that the charging port can open and close, is of a sliding door type, and further, the lid body can be operated without climbing to the top portion of the container vessel. Therefore, according to the bulk container having such a configuration, it is possible to efficiently and safely receive cargo from a hopper or the like.

Further, it is particularly preferable that the operation member described above is provided in the side part of the container vessel at a position above the discharging port used for discharging the cargo, or in the top portion of the container vessel at a position close to a side part including the discharging port.

In the bulk container illustrated in FIGS. 12A, 12B and FIG. 14 and the like, the operation member 80 is also provided in the top portion of the container vessel 3 at a location close to the side part including the discharging port 8.

As described above, the operation member used for reciprocating the lid body is preferably provided in any one among the side part (side wall surface) of the container vessel or at a position on the top portion close to the side part. When the operation member is provided in the side part of the container vessel, an optimal position is a position above the discharging port that discharges the cargo. When the operation member is provided in the top portion of the container vessel, it is most advantageously to choose a location in the top portion close to the side part where the discharging port is located. This is because, by adopting such a configuration, it is possible to arrange the locations of the container vessel that require manipulation in a concentrated manner in one side part or in the vicinity thereof.

A so-called bulk container for handling powdery or granular cargo includes a charging port in a top portion of a box-shaped container vessel and a discharging port in a lower portion of one side part (side wall surface), and generally, does not include any other operation portions that require manipulation. The discharging port is opened and closed by using an operation lever attached to a hatch of the discharging port. Therefore, if the operation member used for operating the lid body of the charging port is provided at a position above the side part where the discharging port is provided, or in a top portion close to the side part, it is possible to provide locations for operating the operation portions in a concentrated manner at or in the vicinity of the one side part. When all operation portions are arranged in such a concentrated manner, the bulk container can be easily and efficiently handled.

In the bulk container according to the invention, it is more preferable that partition plates are provided at a plurality of locations in an upper part of the inside of the container vessel, excluding a center part of the container vessel in the length direction, each of the partition plates includes a surface intersecting the length direction of the container vessel, and an upper end part of each of the partition plates is supported, and the partition plate is swingably provided and configured to displace only between a position in which a lower part faces vertically downward and a position in which the lower part faces to a side opposite to the center part (the lower part faces to a side away from the center part).

FIGS. 17A to 17D illustrate a bulk container 4 including partition plates 90 having such a configuration at two locations within the container vessel 3. Each of the partition plates 90 can freely swing only between a position in which the lower part faces vertically downward and a position when the lower part has been swung, as indicated by an imaginary line, to a side opposite to the center part of the container vessel in the length direction.

When powdery or granular cargo is charged into the container vessel from the charging port, the cargo accumulates in a conical shape as described above. Therefore, even if the cargo reaches the height of the charging port at or in the vicinity of the center, a large empty space may remain in the vicinity of both end parts of the container vessel in the length direction. In such a case, by repeatedly performing operation including driving a vehicle onto which the container vessel is loaded over a short distance backward and forward and then suddenly stopping the vehicle, the powdery or granular cargo can be moved into the empty space, and subsequently, cargo can be further charged from the charging port.

When the powdery or granular cargo is moved within the container vessel in this manner, the movement of the powdery or granular cargo can be facilitated by arranging, in the container vessel, the partition plate capable of swinging to only one side, as described above. This is because, as mentioned above, the partition plate capable of swinging to only one side does not hinder the movement of cargo toward the side away from the center part of the container vessel (that is, the side where powdery or granular cargo does not easily accumulate and an empty space is created), but hinders the movement of cargo from the end part toward the center part. That is, by providing the partition plate, it is possible to promote the movement of the powdery or granular cargo from the center part of the container vessel toward the end part. Therefore, it is possible to quickly eliminate an uneven accumulation state of the cargo and increase the capacity of the cargo accommodated in the container vessel.

Advantageous Effects of Invention

According to a bulk container of the invention, a lid body covering a charging port in an upper part of the bulk container can be opened and closed at a position directly below a supply device such as a hopper, and further, a worker does not need to climb to the upper part of the container to open and close the lid body. Therefore, the lid body can be opened and closed efficiently and safely, and it is possible to smoothly perform work for receiving cargo from the hopper or the like.

If the lid body reciprocates in conjunction with an operation member via a transmission mechanism including a cord body and a pulley, the lid body can be appropriately moved to open and close the charging port, by using an operation member provided at a position that is easy to operate, such as a side part of a container vessel. When the force that moves the operation member is transmitted to two locations on the lid body via the cord body, the lid body can be moved smoothly and reliably by a worker who moves the operation member only at one location.

Also in a configuration in which a low friction linear guide device referred to as a linear bush or a linear guide is arranged in the vicinity of both end parts of the charging port and the lid body can move by the action of the linear guide device, the lid body can always smoothly reciprocate to open and close the charging port, only by an operation to the operation member arranged at one location.

The operation member that opens and closes the lid body covering the charging port in the upper part is advantageous for efficiently and safely opening and closing the lid body, both in a case of being provided in a side part of the container vessel, and in a case of being provided at a position in the top portion of the container vessel close to any side part. In both cases, a worker does not need to climb to the upper part of the container to open and close the lid body. In particular, if the operation member is provided at an upper part of the side part where the discharging port is provided or in the top portion close to the side part, it is possible to design a bulk container that is easy to handle, because locations of the container vessel where manipulation is required are placed in a concentrated manner.

When a partition plate that is swingable only to one side, that is, to a side away from the center part, is appropriately arranged in an upper part of the inside of the container vessel, an uneven accumulation state of the powdery or granular cargo can be easily eliminated and the capacity of the cargo accommodated in the container vessel can be increased.

BRIEF DESCRIPTION OF DRAWINGS

FIG. 4 also illustrates details of an encircled portion as an extracted drawing.

FIG. 5 also illustrates details of encircled portions as extracted drawings.

FIG. 9 also illustrates details of encircled portions as extracted drawings.

FIG. 10 also illustrates details of encircled portions as extracted drawings.

FIGS. 11A and 11B illustrate an example in which an inclined plate 71 is provided immediately below the charging port 5, and FIG. 11C illustrates an example in which an impeller 72 is provided at a similar position as the inclined plate 71.

FIG. 16A is a cross-sectional view taken along line XVI-XVI in FIG. 14. Further, FIG. 16B is a detailed view of a portion b in FIG. 16A, and FIG. 16C is a detailed view illustrating the portion b in a state where plates of the lid body 6 are opened.

FIG. 17A is a longitudinal sectional view of the container vessel 3. Further, FIG. 17B is a view along arrows b-b in FIG. 17A, FIG. 17C is a detailed view of a part c in FIG. 17B, and FIG. 17D is a cross-sectional view taken along line d-d in FIG. 17C.

DESCRIPTION OF EMBODIMENTS

Figure 1A:
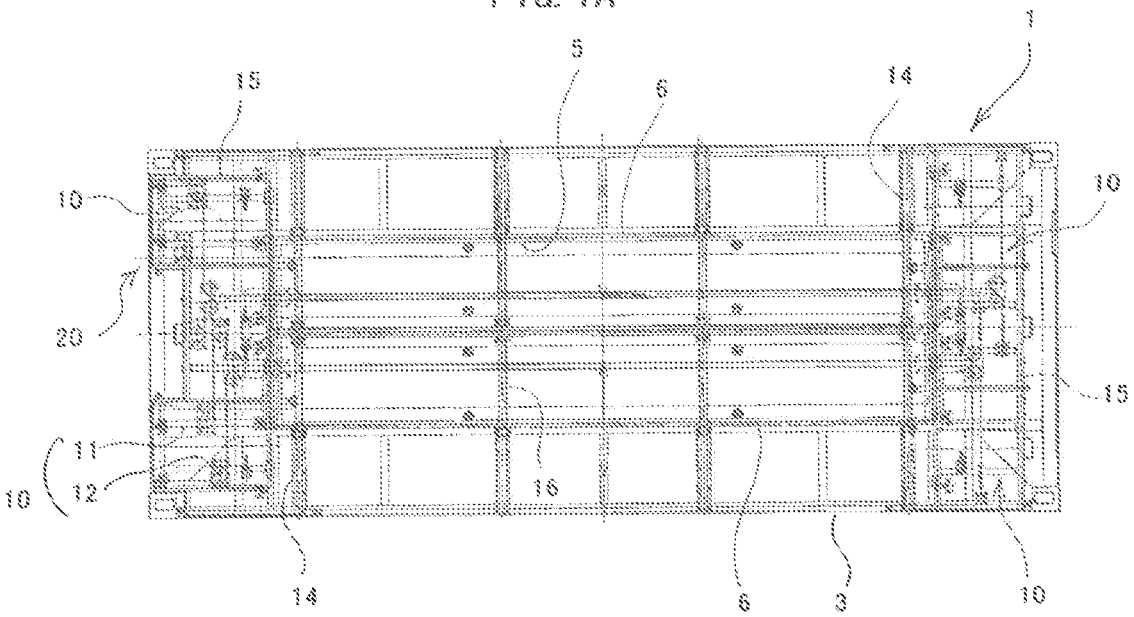
FIG. 1A is a plan view and FIG. 1B is a side view illustrating a bulk container 1 which is a first embodiment.

FIGS. 1A to 5 illustrate a bulk container 1 which is an embodiment of the invention. The bulk container 1 receives cargo in a powdery or granular state such as wood pellets from an upper part, and is used for storing or transporting the cargo, and the cargo can be discharged from a discharging port 8 in a lower part of the bulk container 1. FIGS. 1A and 1B illustrate a plan view and a side view of the bulk container 1.

The bulk container 1 includes, as a main component, a container vessel 3 formed of a metal or the like and having a rectangular parallelepiped box shape, and in the bulk container 1, a charging port 5 is provided in a top portion, and a discharging port 8 is provided at a lower position in an end part in a length direction. A lid body 6 of a sliding door type is attached to the charging port 5 in the upper part of the bulk container 1, and a door 9 of a hinged door type is attached to the discharging port 8. The container vessel 3 illustrated in the drawings has approximate dimensions including a length of about 6 m, a width of about 2.5 m, and a height of about 3 m, but the invention is not limited to these dimensions.

Figure 2:
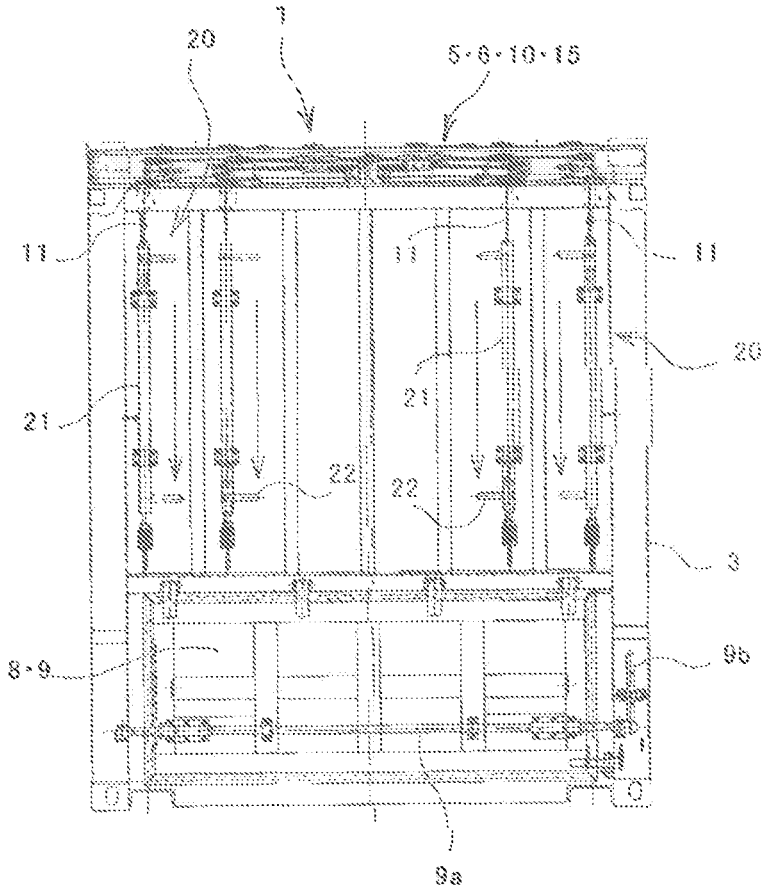
FIG. 2 is a front view of the bulk container 1 (a view taken along arrows II-II in FIG. 1B).

The discharging port 8 and the door 9 provided thereon have a similar configuration as in a general bulk container of the related art. That is, as illustrated in FIG. 2 (lower half part of FIG. 2), the door 9 made of metal is attached to an opening of the discharging port 8 so that a lower part of the door 9 supported by a hinge of an upper part of the door 9 swings to open and close the door 9. The door 9 can be opened and closed by locking the door 9 to the frame of the container vessel 3 by a locking rod 9*a* or unlocking the door 9. The locking and unlocking by the locking rod 9*a* can be performed by operating a lever 9*b*.

As illustrated in FIG. 1A, the charging port 5 is an opening that is long (about 4.5 m long and about 1 m wide) along a longitudinal direction of the container vessel 3, and is provided at a center position in a width direction of the vessel 3. A lid body 6 formed of a metal plate or the like is attached to the charging port 5 as a sliding door type cover. The lid body 6 is a set of two plates. When the two plates abut against each other at a center part of the container vessel 3, the two plates cover the entire charging port 5, and substantially the entire charging port 5 can be opened by sliding the plates horizontally outward in the width direction from the center part to move and separate the plates.

Figure 1B:
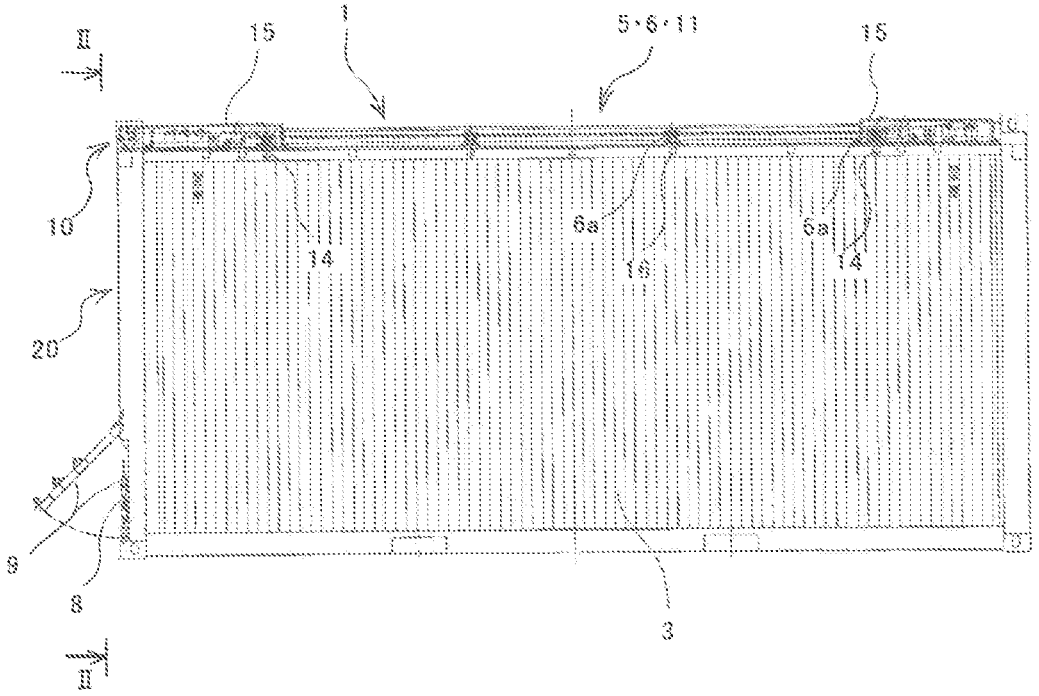
Figure 5:
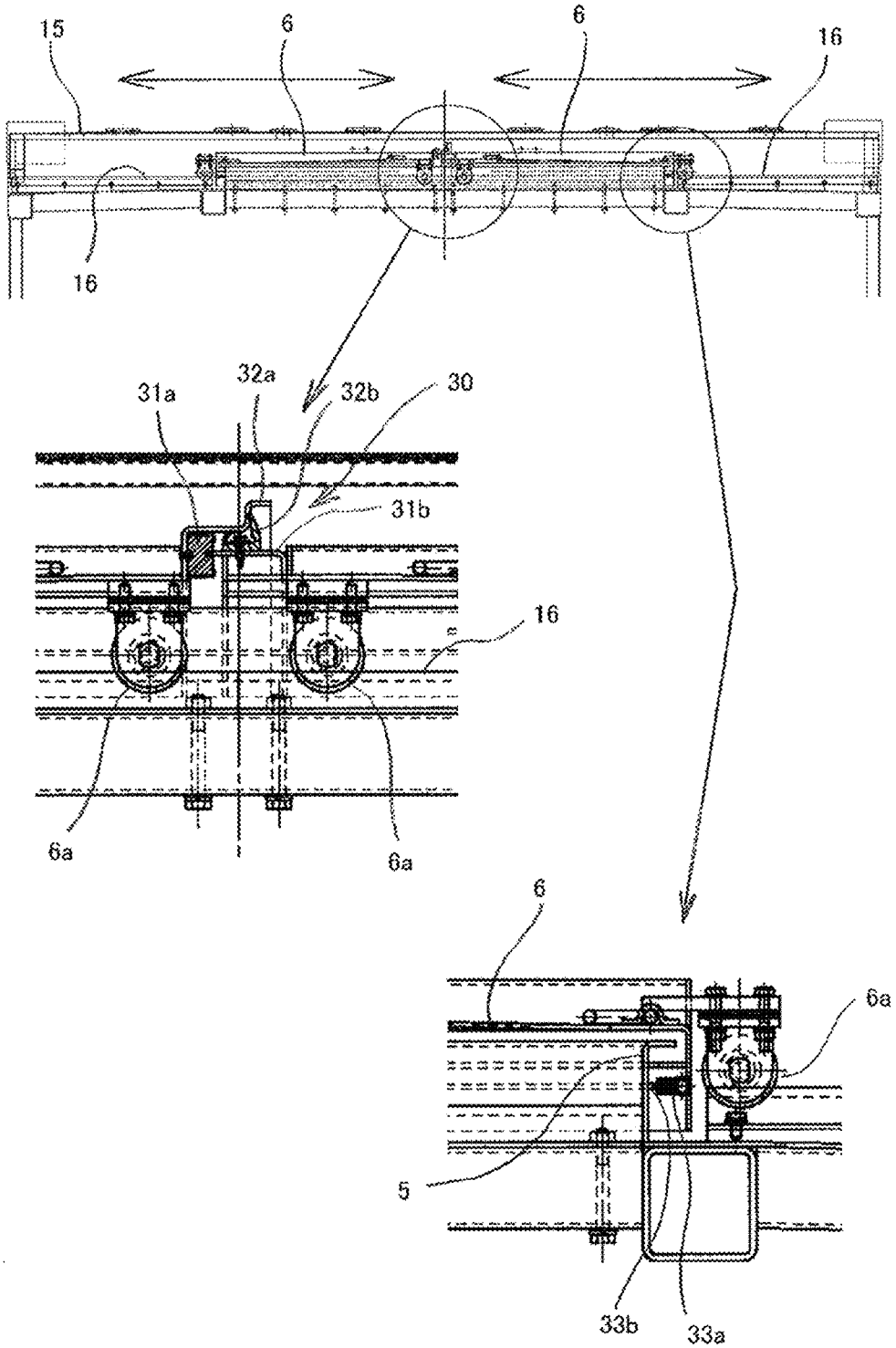
FIG. 5 is a cross-sectional view taken along line V-V in FIG. 3, and also illustrates the upper part of the bulk container 1.

As illustrated in FIG. 1B or FIG. 5, the lid body 6 includes a plurality of wheels 6*a* attached to a lower surface side of each plate. The wheels 6*a* are placed on guide tracks 14 and support rails 16 that span in parallel across the charging port 5, and thus, reciprocating motion in the width direction of the container vessel 3 can be achieved. The guide tracks 14 mainly guide the movement of the lid body 6, and the support rails 16 supports a middle portion of the lid body 6 to prevent a deformation of the lid body 6.

Figure 4:
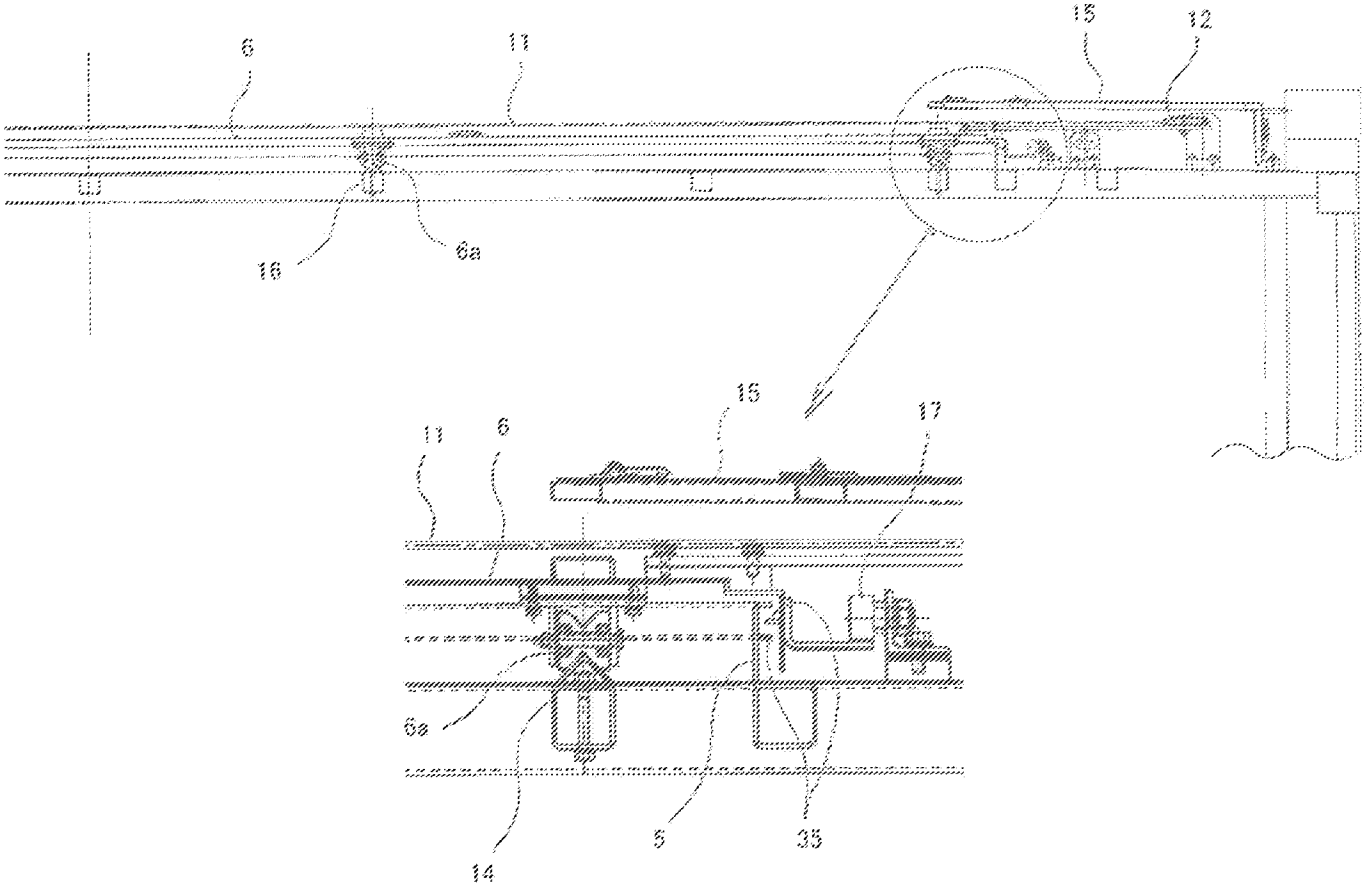
FIG. 4 is a cross-sectional view taken along line IV-IV in FIG. 3, and illustrates an upper part of the bulk container 1.

As illustrated in FIG. 4, the guide tracks 14 and the support rails 16 described above are shaped so that a center part protrudes upward. The wheels 6*a* provided in the lid body 6 are tsuzumi-shaped wheels that can move in a state of spanning over the protruding portion, so that the wheels 6*a* can move along the guide tracks 14 and the support rails 16. Accordingly, the wheels 6*a* do not derail, and the powdery or granular cargo being charged is not likely to adhere to or accumulate on the guide tracks 14 or the support rails 16, so that the lid body 6 can always be moved smoothly.

In order to prevent the lid body 6 from uplifting from the guide tracks 14, as illustrated in (the extracted drawing of) FIG. 4, a pressing roller 17 attached to the container vessel 3 is contacted with a top surface of an edge part of the lid body 6.

In the example of FIGS. 1A to 5, an operation member 20 (see FIG. 2) of manual type is provided on one end side surface of the container vessel 3 as a means for driving the reciprocating movement of the lid body 6. The movement of the operation member 20 is transmitted to the lid body 6 by a transmission mechanism 10 illustrated in FIG. 3 including wire ropes 11 and pulleys 12 and 12*a*. When one of the wire ropes 11 is pulled by operating the operation member 20, the wire rope 11 hooked on the pulley 12 is displaced, and thus, the lid body 6 is moved in one direction. In order to protect the pulley 12 and the like from rainwater and to prevent rainwater from entering the charging port 5, as illustrated in FIGS. 1A and 1B, side covers 15 are attached to both end parts in the length direction of the upper part of the container vessel 3.

A configuration of the operation member 20 is illustrated in FIG. 2. Pipes 21 are attached to the end side surface of the container vessel 3, and a traction tool (not illustrated) connected to the wire rope 11 is inserted inside each of the pipes 21 so as to move up and down. Further, operation levers 22 are attached to the traction tool, and the operation levers 22 each protrude from a slit (not illustrated) formed in a side portion of the pipe 21 to the outside. When any one of the operation levers 22 is held by a hand and pulled down, the wire rope 11 coupled thereto can be pulled. Note that the lever 22 is designed so that a position of the lever 22 can be fixed after being operated.

Figure 3:
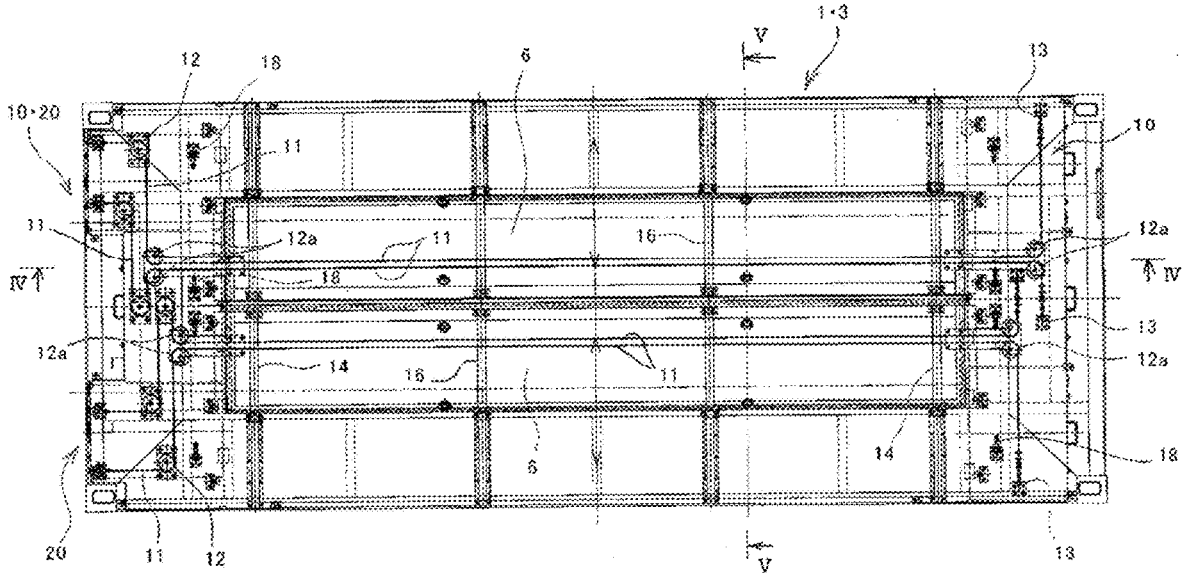
FIG. 3 is a plan view illustrating the bulk container 1 of FIG. 1A from which a side cover 15 for a lid body 6 is removed.

The transmission mechanism 10 including the wire ropes 11 is configured as illustrated in FIG. 3. The wire ropes 11 that can be pulled by the operation lever 22 are hooked on a plurality of fixed pulleys 12 on the container vessel 3 and movable pulleys 12*a* on a frame that moves integrally with each plate of the lid body 6. The end parts of the wire ropes 11 are tied to anchors 13 fixed on the container vessel 3.

Two of the wire ropes 11 are used for each of the two plates that constitute the lid body 6 for the forward and backward movements, so that a total of four of the wire ropes 11 are stretched over the upper part of the container vessel 3. Two of the movable pulleys 12*a* are used for one of the wire ropes 11, and the two movable pulleys 12*a* are attached to (the above-described frame of) each plate of the lid body 6 at positions separated in the length direction (that is, a direction perpendicular to a movement direction) of the lid body 6. When the one wire rope 11 is pulled, a force in an opening direction or a closing direction of the lid body 6 acts on the two movable pulleys 12*a* positioned at separate positions, and the plate moves. By the two movable pulleys 12*a*, each plate of the lid body 6 is evenly subjected to a force in the movement direction at two locations separated in the length direction. Therefore, the lid body 6 can be accurately translated to open and close the charging port 5, without inclining or being caught in the guide tracks 14. A stopper 18 having an adjustable tip position is attached to the upper part of the container vessel 3, and thus, a movement range of each plate of the lid body 6 is limited.

The wire rope 11 and the pulleys 12 and 12*a* are arranged for each of the opening and closing directions for each of the two plates of the lid body 6, and thus by operating each of the levers 22 of the operation member 20 illustrated in FIG. 2, the plates of the lid body 6 can be freely opened and closed.

A sealing mechanism 30 is provided in the two plates of the lid body 6 to prevent rainwater from entering between the two plates (between tip end edge parts abutting against each other) when the charging port 5 is closed. A structure of the sealing mechanism 30 is illustrated in FIG. 5 (extracted drawing in the middle). That is, an elastic packing 31*a* and a metal member 31*b* are provided between the tip end edge parts of the two plates that abut against each other when the charging port 5 is closed. The elastic packing 31*a* made of rubber is attached to an edge part of one of the plates, and the metal member 31*b* is provided on an edge part of the other plate to be pressed against an end surface of the elastic packing 31*a* in a horizontal direction.

In the example of FIG. 5, in order to surely prevent rainwater from entering, in addition to the combination of the packing 31*a* and the metal member 31*b* described above, a tongue-shaped rubber packing 32*b* is attached to a part of the metal member 31*b* so that the tongue-shaped rubber packing 32*b* is pressed in the horizontal direction against a metal piece 32*a* extending from the plate to which the elastic packing 31*a* is attached. That is, two structures in which the metal member is pressed horizontally against the elastic packing are provided.

In order to prevent rainwater from entering when the lid body 6 is closed, a water sealing structure similar to the sealing mechanism 30 described above is also provided between a rear end edge part of one of the plates (an edge part on a side opposite to the side where the two plates abut against each other) and an edge part of the charging port 5. That is, as illustrated in FIG. 5 (extracted drawing on the bottom), an elastic packing 33*a* is attached inside the edge part of the lid body 6, and a metal member 33*b* is provided outside the edge part of the charging port 5, so that the metal member is pressed against the elastic packing in the horizontal direction when the lid body 6 is closed.

As illustrated in (the extracted drawing of) FIG. 4, between both end edge parts of the charging port 5 in the length direction and a side edge part of the lid body 6 (an edge part along the movement direction of the lid body 6), in addition to covering the side edge parts of the lid body 6 with the side covers 15, a water intrusion prevention piece 35 is attached between the two edge parts mentioned above.

FIGS. 6A to 10 illustrate a bulk container 2 which is another embodiment of the invention. Similarly to the bulk container 1 illustrated in FIGS. 1A, 1B and the like, the bulk container 2 is used for receiving powdery or granular cargo from the charging port 5 in the upper part of the bulk container 2, and the cargo may be discharged from the discharging port 8 in the lower part of the bulk container 2. The structure of the discharging port 8 and the door 9 of a hinged door type for opening and closing the discharging port 8 is not different from that of the bulk container 1. The same applies to the size of the container vessel 3.

Similarly as in the bulk container 1 described above, the charging port 5 in the upper part of the bulk container 2 is an opening that is long along the longitudinal direction of the container vessel 3, and the lid body 6 of a sliding door type is provided in the charging port 5. In addition, similarly as in the bulk container 1, the lid body 6 is a set of two plates, when the two plates abut against each other at a center part of the container vessel 3, the two plates cover the entire charging port 5, and sliding the plates horizontally outward in the width direction from the center part to move and separate the plates results in opening of the charging port 5.

Figure 7:
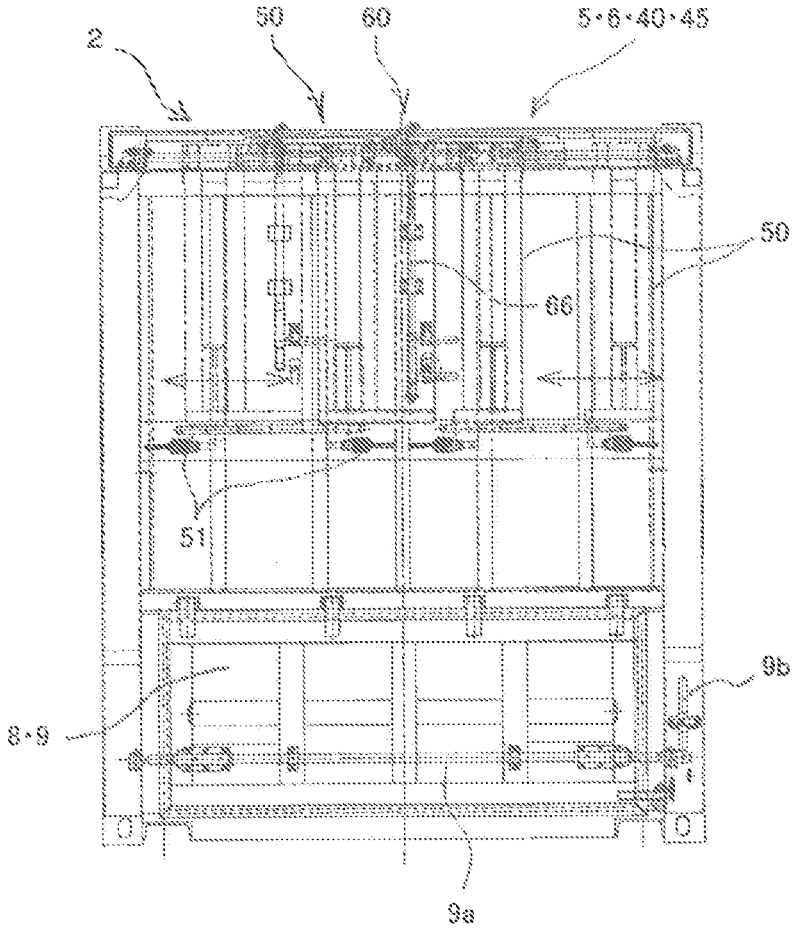
FIG. 7 is a front view of the bulk container 2 (a view taken along arrows VII-VII in FIG. 6B).

However, in the bulk container 2, the transmission mechanism including wire ropes and pulleys is not employed as a means for moving the lid body 6. As illustrated in FIG. 7, an operation member 50 arranged on one end wall surface of the container vessel 3 is directly coupled to one end part of each plate of the lid body 6, and the operation member 50 is manually operated by a worker to move each plate of the lid body 6 in a reciprocating manner.

Figure 6A:
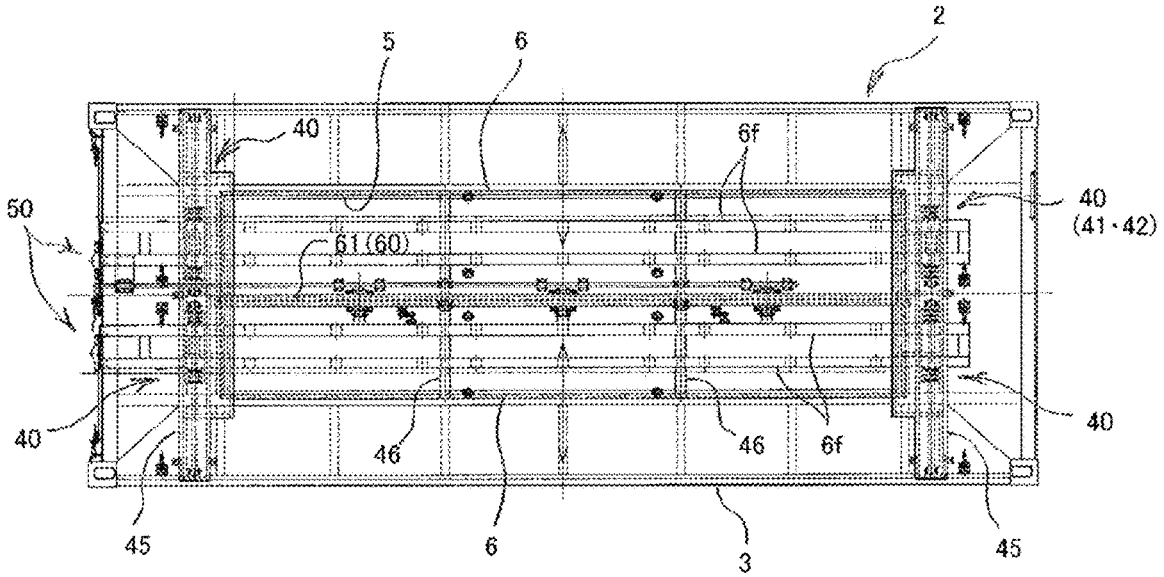
FIG. 6A is a plan view and FIG. 6B is a side view illustrating a bulk container 2 which is a second embodiment.
Figure 6B:
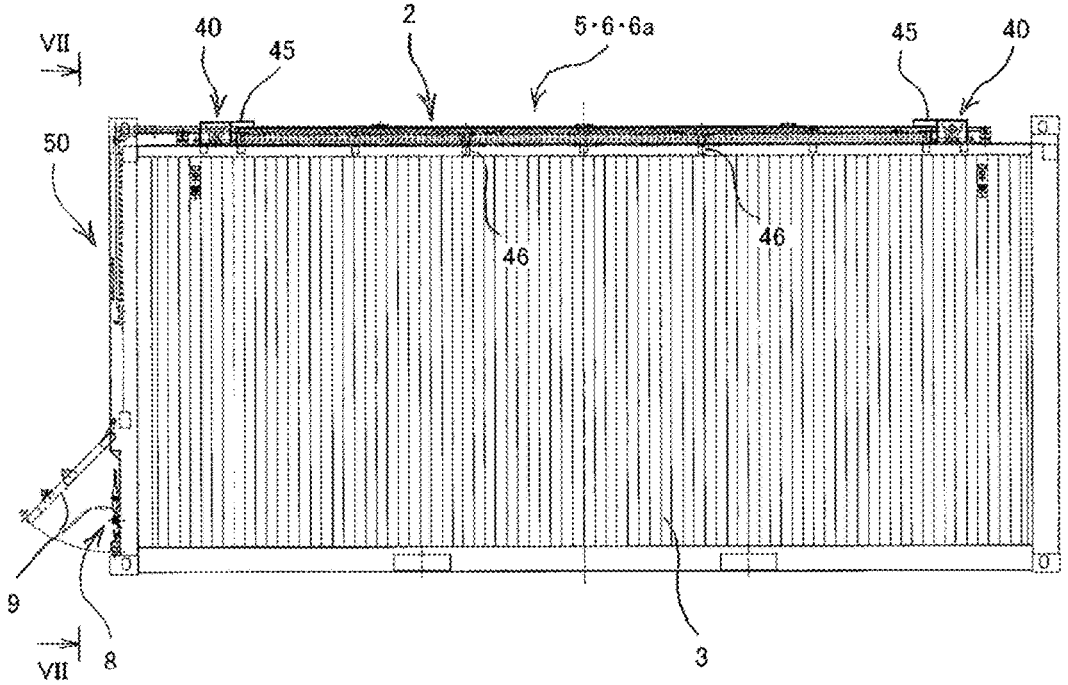
Figure 8:
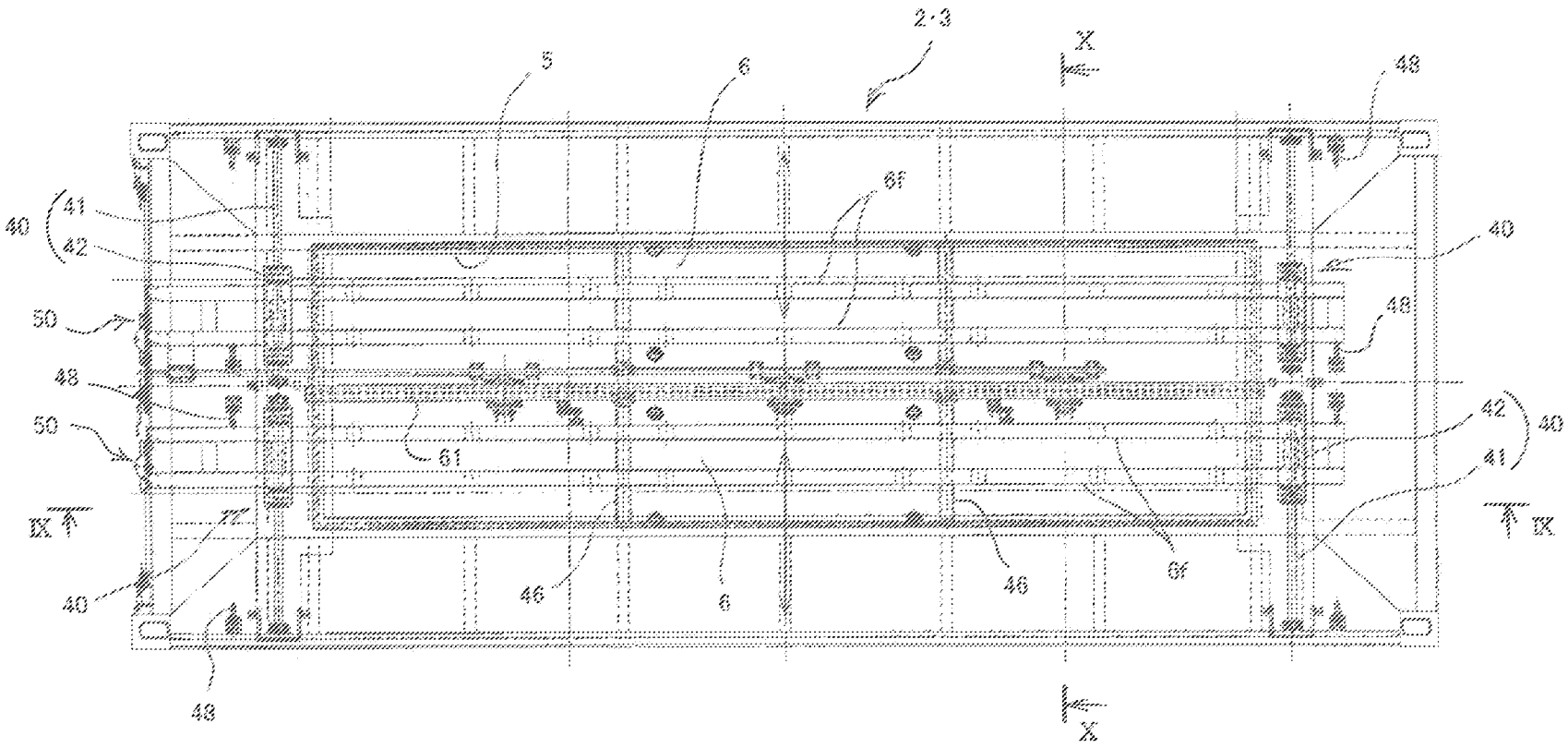
FIG. 8 is a plan view illustrating the bulk container 2 of FIG. 6A from which a side cover 45 for the lid body 6 is removed.
Figure 9:
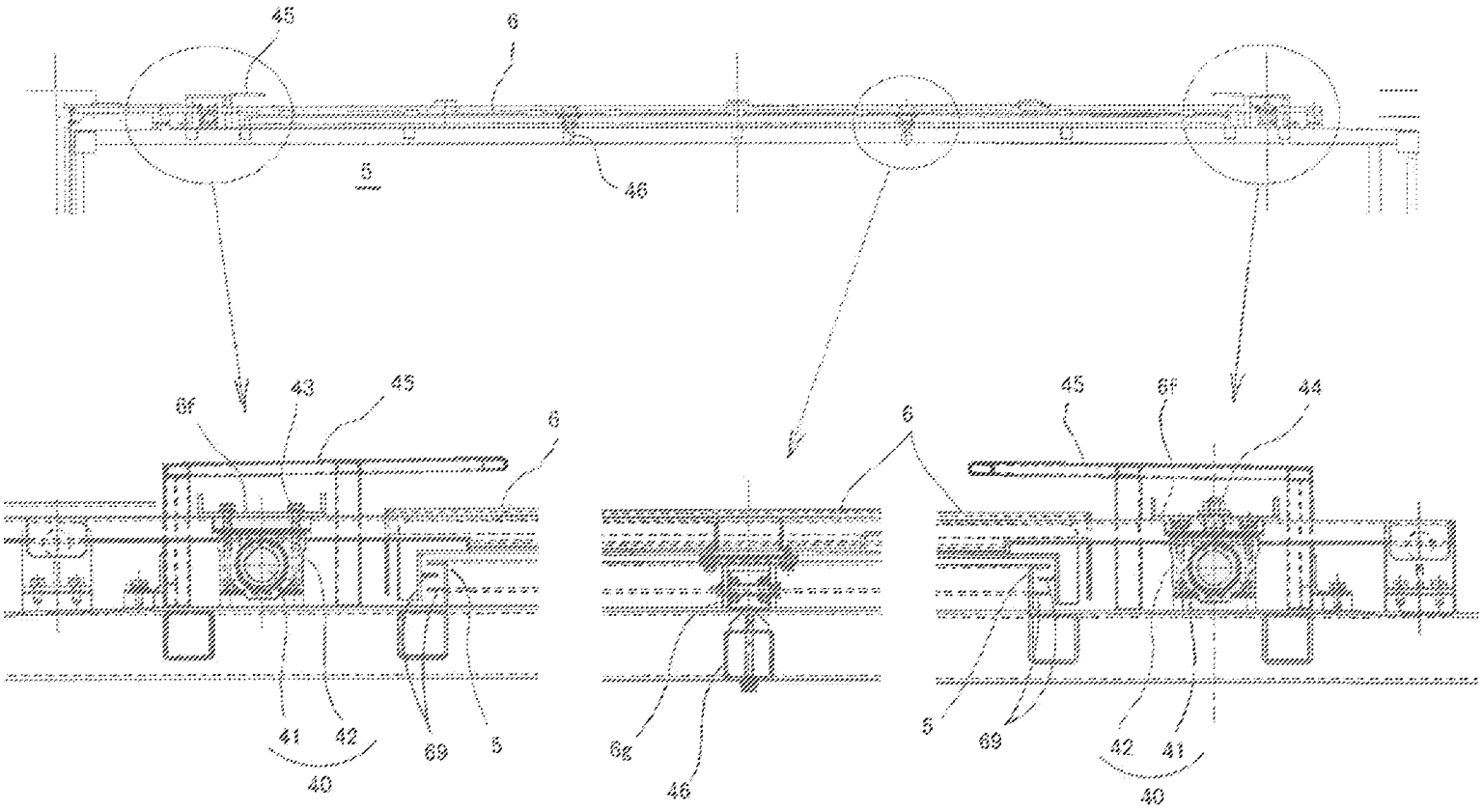
FIG. 9 is a cross-sectional view taken along line IX-IX in FIG. 8, and illustrates an upper part of the bulk container 2.

In this case, as illustrated in FIGS. 6A and 6B, considering that the lid body 6 that is longitudinally long and covers the charging port 5 that is longitudinally long, is moved in the width direction by a force applied only at one end part (the left end side in FIGS. 6A and 6B), each plate of the lid body 6 is supported by linear bush devices 40 provided in the vicinity of both end parts in the length direction. As illustrated in FIGS. 8 and 9, the linear bush device 40 is a linear guide device including a linear guide member 41 and a moving block 42 mounted outside the guide member 41 via a rolling body (not illustrated) such as a ball and a roller. If the guide member 41 is fixed in the width direction of the container vessel 3, each plate of the lid body 6 attached to the moving block 42 can move along the guide member 41 in an opening and closing direction of the charging port 5 with extremely low friction. The movement is smooth, and thus, the lid body 6 always performs a smooth translation, even if the operation member 50 is used to apply force only to one end part.

As illustrated in FIG. 8, each plate of the lid body 6 is coupled to a support frame 6*f* extending in the length direction of the lid body 6, and the moving block 42 described above is attached to the frame 6*f*. The operation member 50 provided on one end wall surface of the container vessel 3 is connected to a tip of the support frame 6*f* by welding or the like. As illustrated in FIG. 7, a fixing tool 51 is provided in the side part of the container vessel 3 where the operation member 50 is arranged, so that the movement of the operation member 50 and the lid body 6 can be locked.

As illustrated in FIGS. 6A and 6B, side covers 45 are provided at positions on both sides to cover the linear bush devices 40 and the end parts of the lid body 6 in the length direction. Thus, the linear bush devices 40 are protected and rainwater is prevented from entering the container vessel 3 from the end parts of the lid body 6.

Further, stoppers 48 having adjustable tip end positions are attached at or in the vicinity of both ends in the length direction in the upper part of the container vessel 3. When the lid body 6 is moved, the tip end parts of the stoppers 48 abuts against a part of the support frame 6*f* mentioned above to limit the movement range of each plate of the lid body 6.

FIG. 9 illustrates a state in which both end parts of the lid body 6 in the length direction are supported by the linear bush devices 40 described above. The two guide members 41 are attached in parallel to each other with an interval of about 4.5 m at or in the vicinity of both end parts of the charging port 5 in the length direction.

In a configuration in which each plate of the lid body 6 is completely fixed to the moving block 42 on each of the guide members 41, if the degree of parallelism between the two guide members 41 decreases, the movement of the lid body 6 may become unsmooth. Moreover, the two guide members 41 are separated by several meters, and thus, the degree of parallelism between the guide members 41 easily decreases. However, in the bulk container 2, it is necessary to move the lid body 6 by using the operation member 50 coupled only to one side of the lid body 6, so that the above-described movement needs to be maintained particularly smooth.

Therefore, in the present example, the frame 6*f* of the lid body 6 is fixed with a bolt 43 to the moving block 42 mounted to one of the two guide members 41 (the guide member 41 on the left side in FIG. 9), and the frame 6*f* of the lid body 6 is attached to the moving block 42 mounted to the other one of the guide members 41 (the guide member 41 on the right side in FIG. 9) so as to be movable. That is, a bolt-shaped coupling pin 44 is attached in an upper part of the moving block 42 illustrated on the right side in FIG. 9, and a gap of several millimeters is provided in the horizontal direction and an up-down direction between the coupling pin 44 and the frame 6*f*.

In the bulk container 2, as illustrated in FIG. 9, support rails 46 span in the width direction at two locations across the charging port 5 in the middle of the length direction, and wheels 6*g* that move on the support rails 46 are attached to a lower part of the lid body 6. Considering that the lid body 6 has a length of about 4 m, this configuration supports the weight of a middle portion of the lid body 6 to prevent deformation of the lid body 6.

The support rails 46 have a shape in which a center part protrudes upward, so that the powdery or granular cargo being charged does not adhere to or accumulate on the support rails 46. The wheels 6*g* provided in the lid body 6 have a common cylindrical shape. In the example illustrated in the drawings, a movement path of the lid body 6 is accurately determined by the linear bush devices 40 and there is no fear of derailment, and thus, the wheels 6*g* are employed.

A special sealing mechanism 60 is provided in order to prevent rainwater from entering the container vessel 3 through the gap between the tip end edge parts of the two plates when the charging port 5 is closed by the two plates of the lid body 6. The two plates of the lid body 6 are operated from only one side by the operation member 50, so that it is difficult to butt the tip end edge parts of both plates with uniform force over the entire length without a gap. In consideration of this point, as illustrated in FIG. 10, the sealing mechanism 60 is configured such that the tip end edge parts of the two plates are covered with a water sealing cover 61 from above and an elastic packing 62 is closely contacted with the plates.

Figure 10:
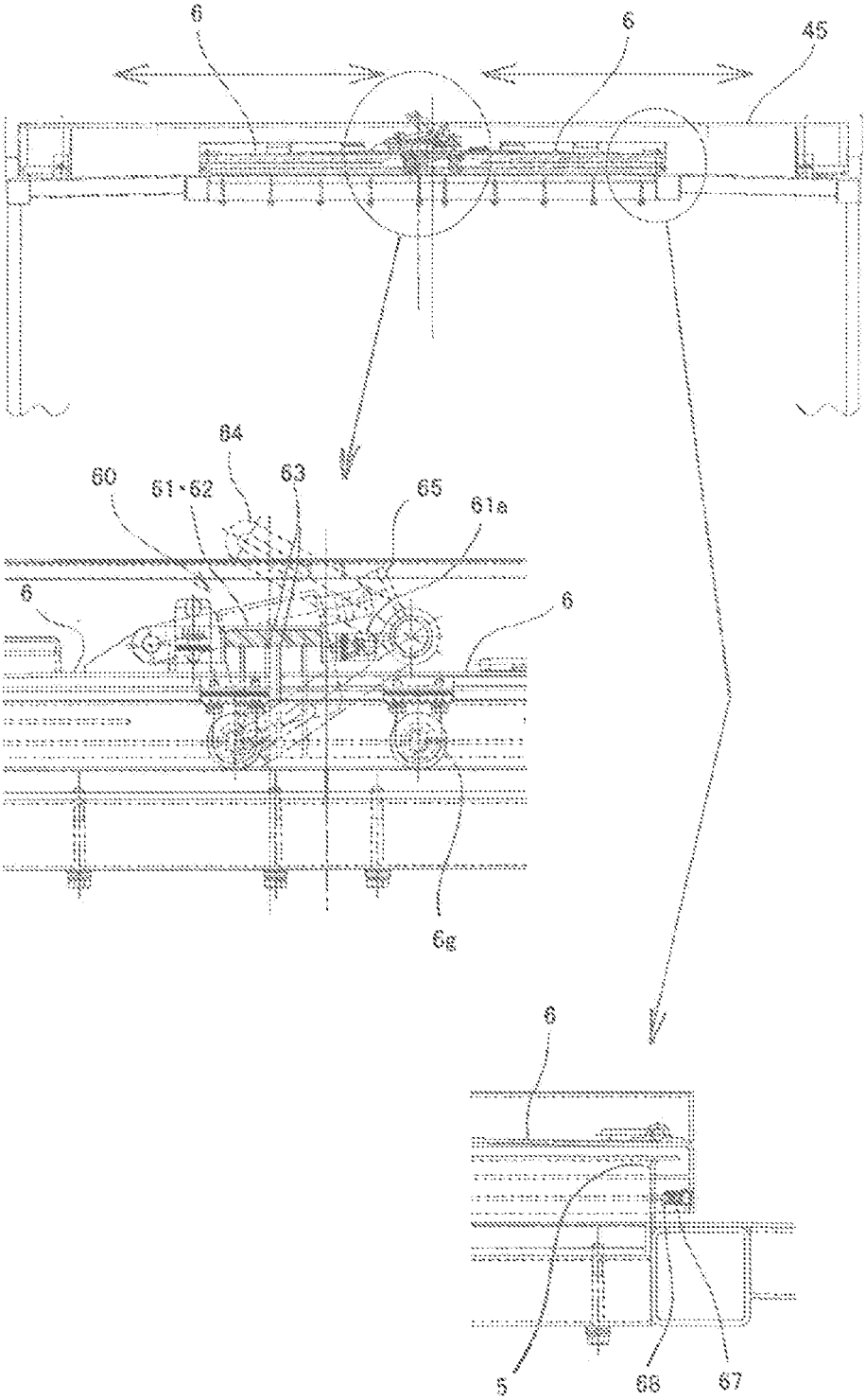
FIG. 10 is a cross-sectional view taken along line X-X in FIG. 8, and also illustrates the upper part of the bulk container 2.

As illustrated in FIG. 10 (extracted drawing in the middle), the water sealing cover 61 is attached to one of the two plates of the lid body 6 so as to be swingable in the up-down direction, and the elastic packing 62 is attached to a lower surface of the water sealing cover 61. On the other hand, two metal members 63 oriented upwardly are attached to each of the tip end edge parts of the two plates of the lid body 6.

The water sealing cover 61 described above is normally in an upwardly displaced state due to the action of a spring (not illustrated). However, when an operation lever 64 attached to the other plate is operated to rotate a push-down member 65 illustrated in the drawing, a tip end part 61*a* is pushed by the push-down member 65, so that the water sealing cover 61 swings downward. When the water sealing cover 61 swings downward, the elastic packing 62 of the water sealing cover 61 is pressed against and comes into close contact with the above-described upwardly oriented metal member 63 of the lid body 6 as illustrated in FIG. 10, and thus, rainwater is prevented from entering through a gap between the tip end edge parts. The operation lever 64 is coupled to a water sealing operation member 66 illustrated in FIG. 7, and thus, the sealed state by the water sealing cover 61 can be maintained by pulling down and fixing (locking) the water sealing operation member 66.

In order to prevent rainwater from entering when the lid body 6 is closed, as illustrated in FIG. 10 (extracted drawing on the bottom), a water sealing structure is also provided between a rear end edge part of one of the plates (an edge part on a side opposite to the side where the two plates abut against each other) and an edge part of the charging port 5. That is, an elastic packing 67 is attached inside the rear end edge part of the plate of the lid body 6, and a metal member 68 is provided outside the edge part of the charging port 5, so that the metal member 68 is pressed against the elastic packing 67 when the lid body 6 is closed.

Further, as illustrated in (the extracted drawings on the left and right side of) FIG. 9, a gap between both end edge parts of the charging port 5 in the length direction and a side edge part of the lid body 6 (an edge part along the movement direction of the lid body 6), is covered by the side covers 45, and a water intrusion prevention piece 69 is attached between the two edge parts mentioned above.

Figure 11A:
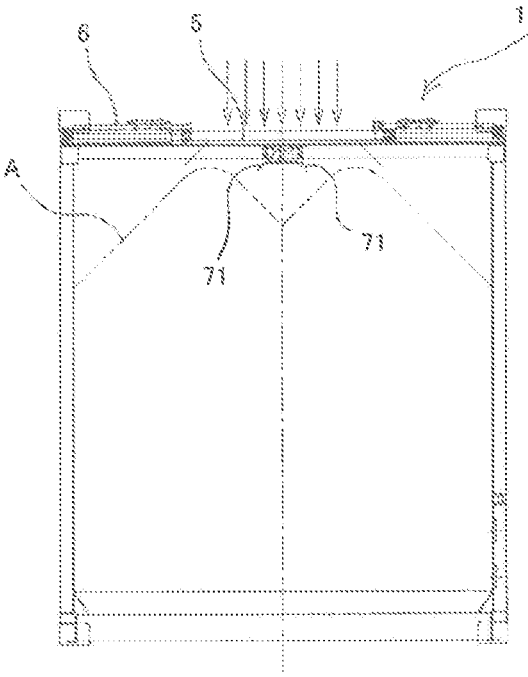
FIGS. 11A to 11C are transverse cross-sectional views of the bulk container 1 or 2, illustrating a state in which cargo A in a powdery or granular state is being charged from a charging port 5 opened by moving the lid body 6 and received in the bulk container 1 or 2.
Figure 11B:
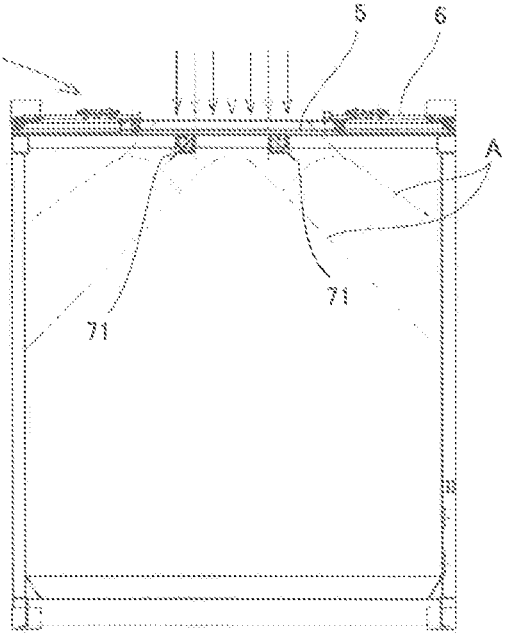
Figure 11C:
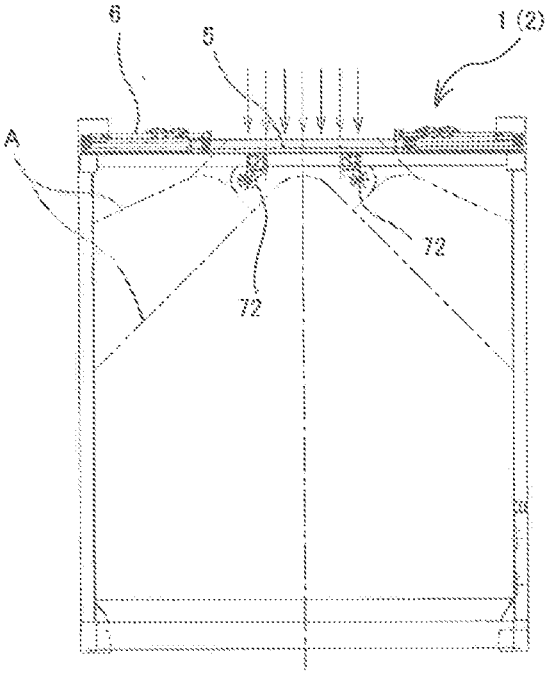

FIGS. 11A to 11C illustrate an example in which inclined plates 71 or impellers 72 are provided directly below the charging port 5 of the container vessel 3. This configuration considers the fact that, if cargo A in a powdery or granular state is charged only at or in the vicinity of a center line of the charging port 5 that is longitudinally long, it may not be possible to fill side positions with the cargo A.

The inclined plates 71 or the impellers 72 are arranged in one row in the length direction of the charging port 5, or in two or three rows with appropriate intervals, and the orientation of the inclined plates 71 or the impellers 72 is adjusted so that the cargo A that is charged at or in the vicinity of the center is dispersed laterally (in the width direction) and drops. FIG. 11A illustrates an example in which two rows of the inclined plates 71 are arranged adjacent to each other in the vicinity of the center of the charging port 5. FIG. 11B illustrates an example in which two rows of the inclined plates 71 are arranged at an interval within the range of the opening of the charging port 5. FIG. 11C illustrates an example in which two rows of the impellers 72 are similarly arranged at an interval. The arrangement of the inclined plates 71 and the impellers 72 is not limited to the examples illustrated in the drawings. By using the inclined plates 71 and the impellers 72 appropriately, the cargo A can be dropped so as to spread not only at or in the vicinity of the center, but also at the left and right sides, and a large amount of the cargo A can also be filled in the side portions, as illustrated in the drawings.

FIGS. 12A to 16C illustrate a bulk container 4 which is yet another embodiment of the invention. Similarly to the bulk containers 1 and 2 described above, the bulk container 4 is used for receiving powdery or granular cargo from the charging port 5 in the upper part of the bulk container 4, and after the cargo is stored or transported, the cargo may be discharged from the discharging port 8 in the lower part of the bulk container 4.

Figure 12A:
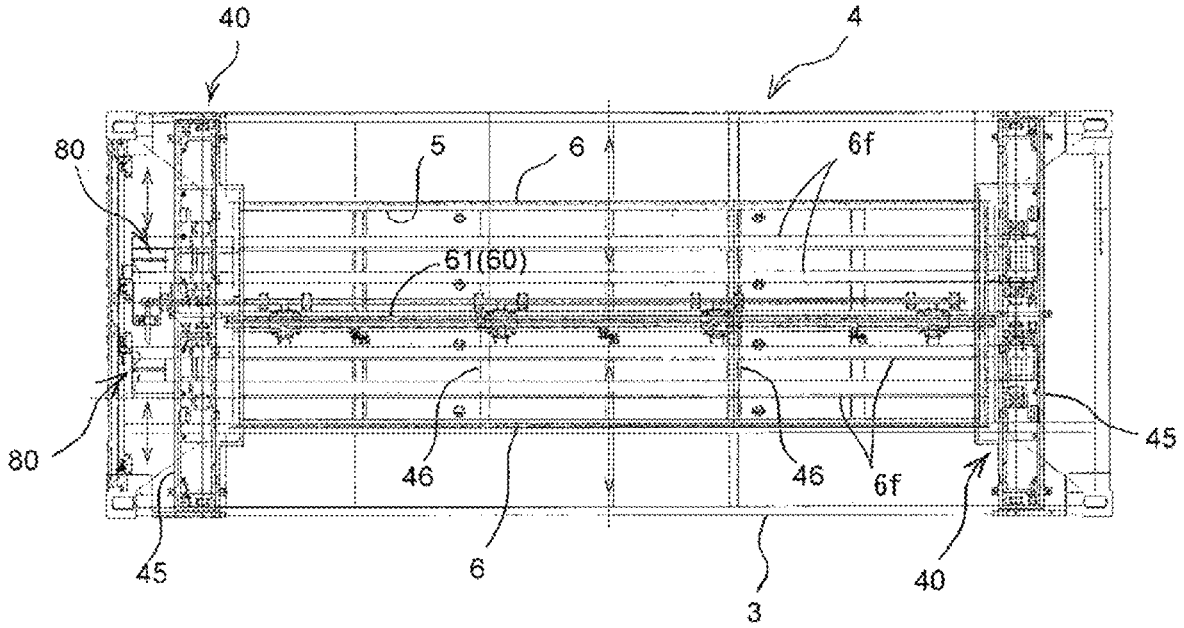
FIG. 12A is a plan view and FIG. 12B is a side view illustrating a bulk container 4 which is a third embodiment.
Figure 12B:
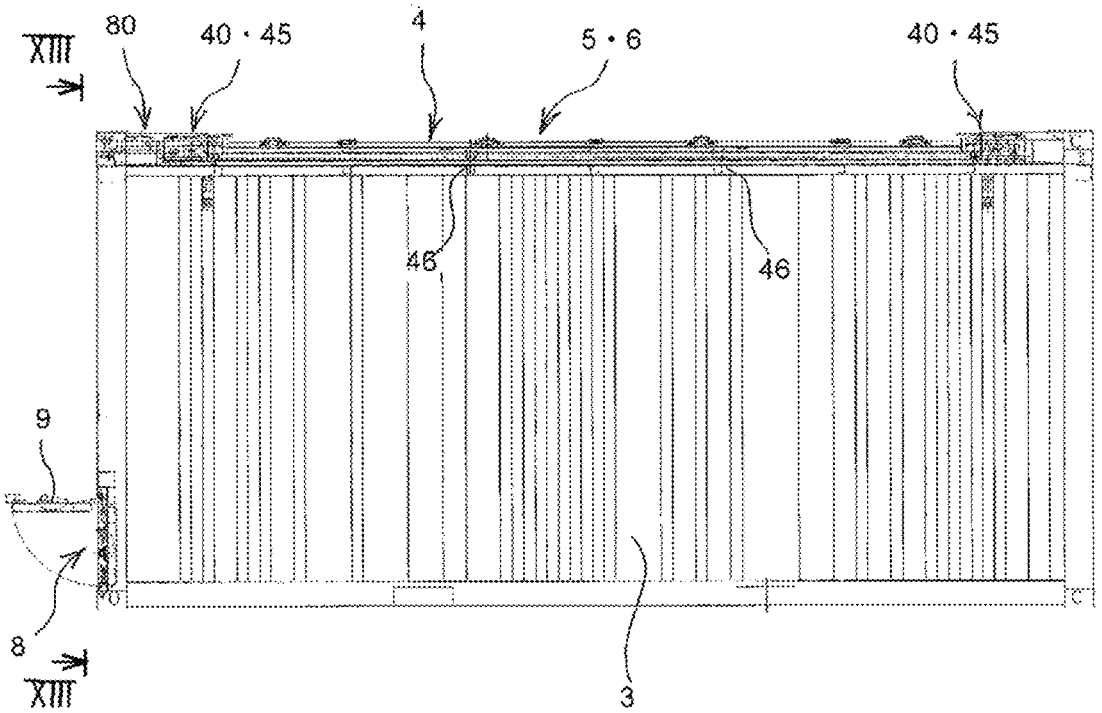
Figure 13:
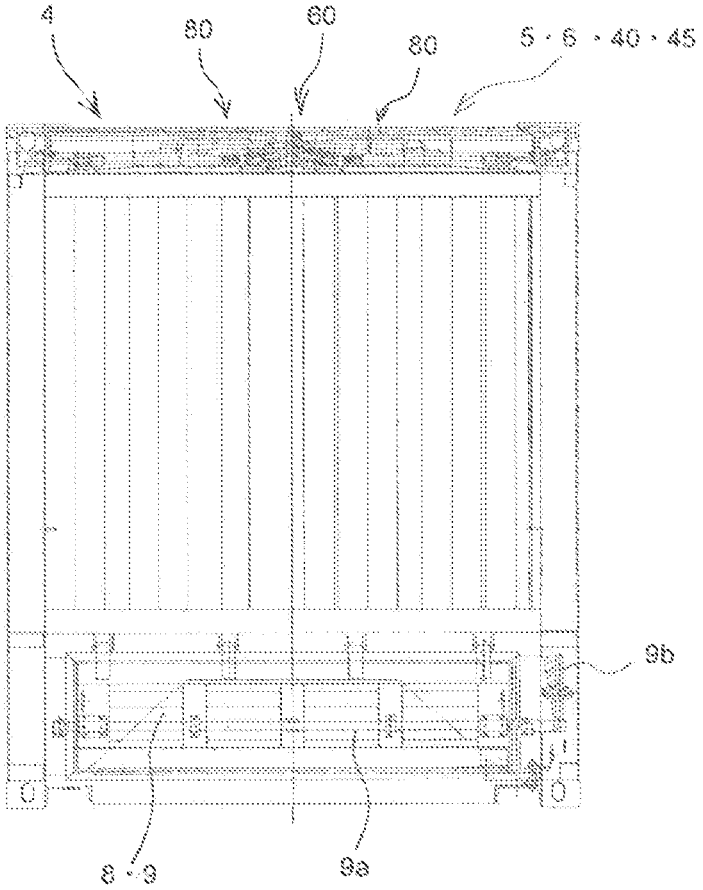
FIG. 13 is a front view of the bulk container 4 (a view taken along arrows XIII-XIII in FIG. 12B).

A configuration of the bulk container 4 is similar to that of the bulk container 2. For example, as illustrated in FIGS. 12A and 12B, the charging port 5 in the upper part of the bulk container 4 is an opening that is long along the longitudinal direction of the container vessel 3, and the lid body 6 of a sliding door type is provided in the charging port 5. In addition, as in the bulk container 2, the bulk container 4 has a configuration in which the lid body 6 is a set of two plates, when the two plates abut against each other at a center part of the container vessel 3, the two plates cover the entire charging port 5, and moving the plates horizontally outward in the width direction from the center part results in opening of the charging port 5.

Figure 14:
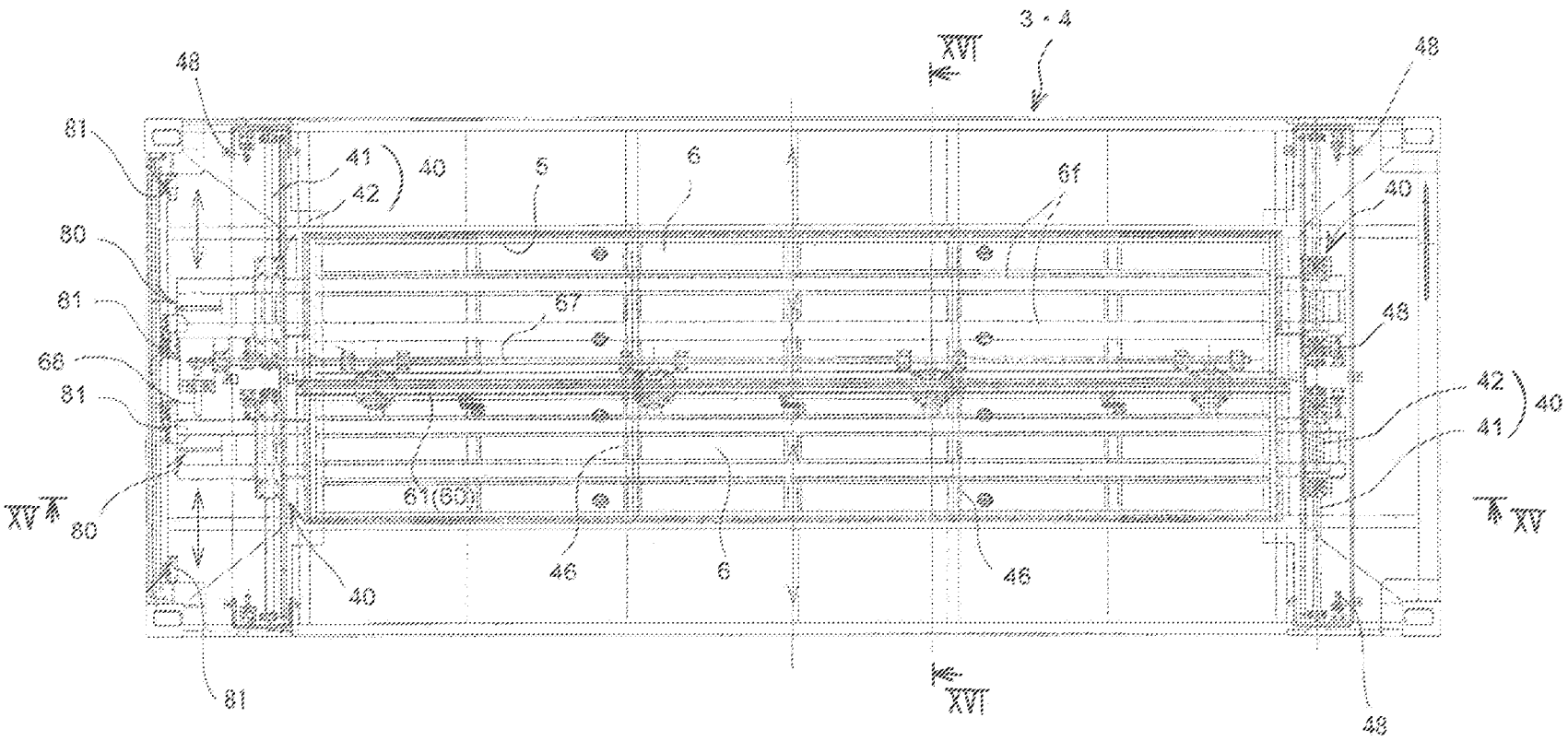
FIG. 14 is a plan view illustrating an upper part of the bulk container 4 of FIG. 12A from which the side cover 45 for the lid body 6 is removed.
Figure 15:
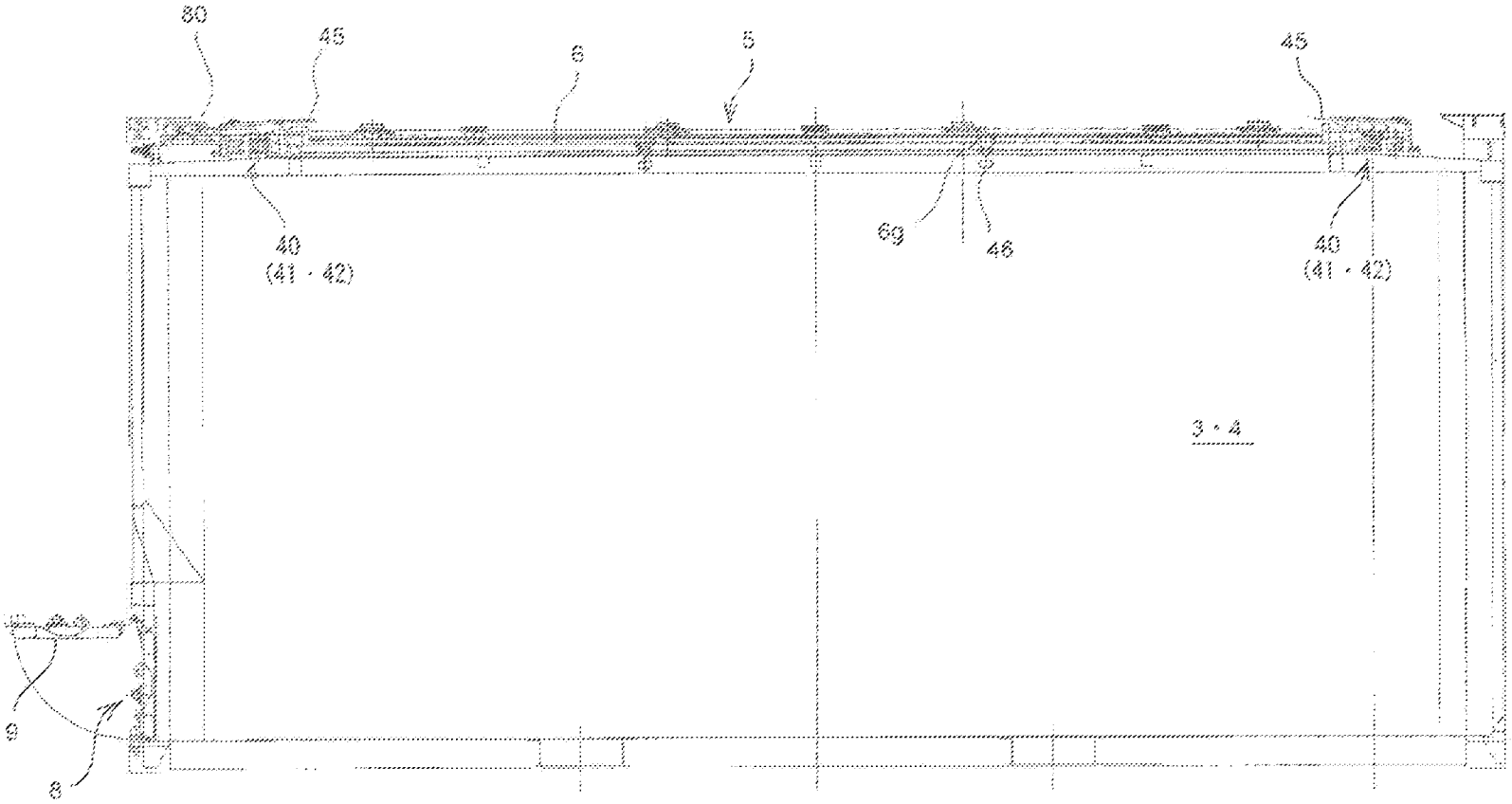
FIG. 15 is a view illustrating the inside of the bulk container 2, and is a cross-sectional view taken along line XV-XV in FIG. 14.

In addition, similarly as in the bulk container 2, the plates of the lid body 6 are supported by the linear bush devices 40 provided at or in the vicinity of both end parts in the length direction, so that each plate can move smoothly with low friction. As illustrated in FIGS. 14 and 15, the linear bush device 40 is a linear guide device including the linear guide member 41 that is long in the width direction of the container vessel 3, and the moving block 42 mounted outside the guide member 41 via a rolling body (not illustrated) such as a ball. The linear bush device 40 is similar to the one used in the bulk container 2. Similarly as in the bulk container 2, the side covers 45 for preventing rainwater from entering are provided at positions on both sides to cover the linear bush devices 40 and the end parts of the lid body 6 in the length direction.

The configuration is in many aspects common with the bulk container 2. Therefore, in the bulk container 4, similar components as those in the bulk container 2 are denoted by the same reference numerals in FIGS. 12A to 16C (and below, redundant descriptions of similar aspects will be omitted or simplified).

Unlike in the bulk container 2, in the bulk container 4, an operation member 80, which is a means for operating each plate of the lid body 6, is provided not in the side part of the container vessel 3, but in an upper part, that is, a top portion of the container vessel 3, as illustrated in FIG. 14. Specifically, the operation member 80 is provided at a location of the top portion near the end wall surface (the wall surface on the side illustrated in FIG. 13) including the discharging port 8 and the door 9 of the discharging port 8. The operation member 80 is held by a hand of a worker to move each plate of the lid body 6 in the width direction of the container vessel 3 (that is, in the opening and closing direction of the charging port 5). The operation member 80 is attached to the support frame 6*f* of each plate of the lid body 6.

In FIG. 14, when the operation member 80 is moved in the width direction of the container vessel 3, the motion is transmitted to each plate of the lid body 6 via the support frame 6*f*. Therefore, the lid body 6 can be moved, and thus the charging port 5 can be opened and closed. Even though the operation member 80 is only placed in the vicinity of one end part of the container vessel 3 in the length direction, as described above, each plate of the lid body 6 is supported by the linear bush device 40 and moves with extremely low friction, so that the entirety of each plate can be translated smoothly.

A fixing tool 81 is provided at a position close to the operation member 80 in the top portion of the container vessel 3 so that the movement of the lid body 6 can be locked when the charging port 5 is fully opened and closed.

Additionally, as illustrated in FIG. 14, in the bulk container 4, similarly to the case of the bulk container 2, the stoppers 48 used for limiting the movement range of each plate of the lid body 6 are attached at or in the vicinity of both ends in the length direction of the upper part of the container vessel 3.

FIG. 15 illustrates a state in which the lid body 6 is supported at the top part of the container vessel 3. As described above, the plates of the lid body 6 are supported by the linear bush devices 40 at both end parts in the length direction. The details are not illustrated in the drawing. However, the lid body 6 is coupled to the moving block 42 of the linear bush device 40 in a manner similar as in the case of the bulk container 2. That is, in order for the lid body 6 to always move smoothly, the frame 6*f* of the lid body 6 is fixed to the moving block 42 mounted to one of the two guide members 41 (for example, the guide member 41 on the left side in FIG. 15), and the frame 6*f* is attached movable by several millimeters in the horizontal direction and the up-down direction, to the moving block 42 mounted to the other one of the guide members 41 (see FIG. 9 illustrating the bulk container 2).

Further, at two locations across the charging port 5 in the middle of the length direction, the support rails 46 span in the width direction and the wheels 6*g* that move on the support rails 46 are attached to the lower part of the lid body 6. By using the support rails 46 having a shape in which the center part protrudes upward, it is possible to prevent powdery or granular cargo from adhering to and accumulating on the support rails 46.

Figure 16A:
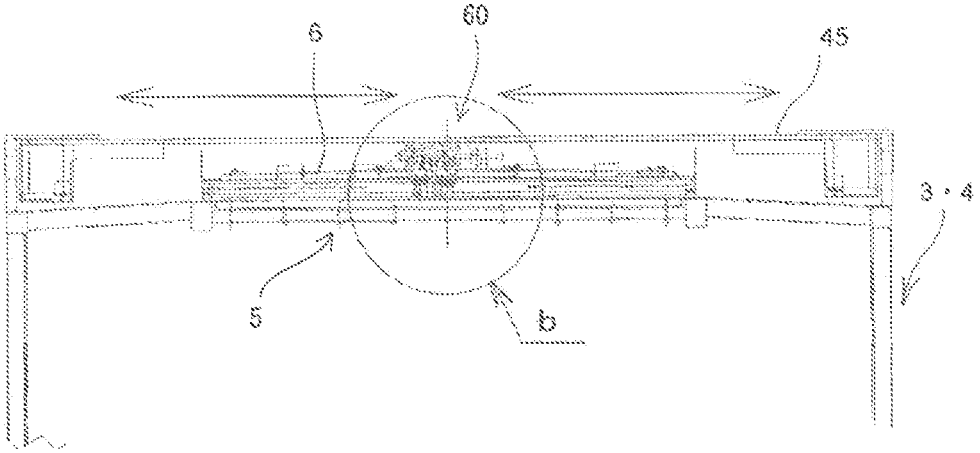
FIGS. 16A to 16C are views illustrating the upper part the bulk container 2.
Figure 16B:
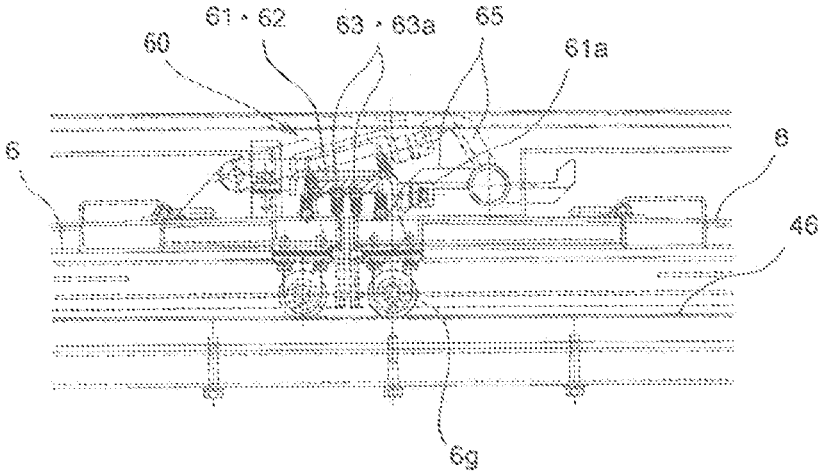
Figure 16C:
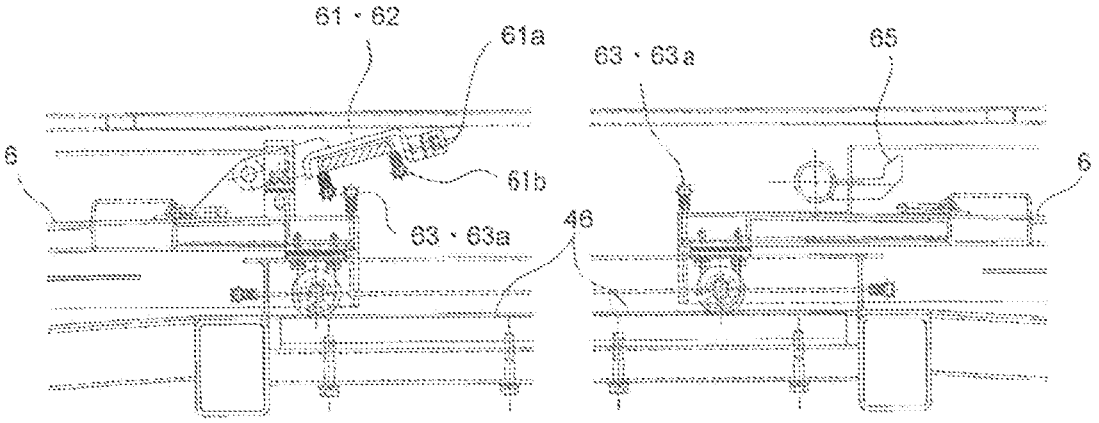

FIGS. 16A to 16C illustrate the sealing mechanism 60 used for preventing rainwater from entering when the charging port 5 is closed by the lid body 6. The sealing mechanism 60 has substantially a similar configuration as that of the sealing mechanism 60 provided in the bulk container 2 (see FIG. 10). That is, in a state where the charging port 5 is closed by the lid body 6, the tip end edge parts of the two plates of the lid body 6 are covered with the water sealing cover 61 from above and closely contacted with the elastic packing 62 on the lower surface of the water sealing cover 61. This prevents rainwater from entering between the tip end edge parts of the two plates, where a gap is easily formed.

As illustrated in FIGS. 16B and 16C, the water sealing cover 61 is attached to one of the two plates of the lid body 6 so as to be swingable in the up-down direction, and the elastic packing 62 is attached to a lower surface of the water sealing cover 61. On the other hand, the metal members 63 oriented upwardly are provided in each of the tip end edge parts of the two plates of the lid body 6. Further, the push-down member 65 of a rotary type is provided on the opposing plate facing the plate to which the water sealing cover 61 is attached. When the push-down member 65 is rotated as illustrated in FIG. 16B, the tip end part 61*a* of the water sealing cover 61 is pushed to swing and rotate downward, and thus, the elastic packing 62 is pressed against and closely contacted with the upwardly oriented metal member 63 of the lid body 6, as illustrated in the figure. In this state, it is possible to exhibit a water sealing effect.

Compared with the sealing mechanism 60 in the bulk container 2 (see FIG. 10), the sealing mechanism 60 of FIGS. 16A to 16C employed in the bulk container 4 includes the following modifications.

First, as illustrated in FIGS. 16B and 16C, the metal members 63 formed on the two plates of the lid body 6 are provided in one row at the tip end edge part of each plate, and a cap 63*a* that is made of soft rubber and is easily elastically deformable is mounted to the upper end part of each of the metal members 63. The front and rear (left and right in the drawings) edge parts of the water sealing cover 61 are extended downward so as to reach the plates of the lid body 6, and a cap 61*b* that is made of soft rubber and is also easily elastically deformable, is attached to each of the lower end parts of the front and rear edge parts. The water sealing effect is enhanced not only by the elastic packing 62, but also by the caps 61*b* and 63*a*, so that it is possible to even more reliably prevent rainwater from entering the container vessel 3.

In addition, a water sealing operation lever 68, which is a means for operating the push down member 65, is provided in the top portion of the container vessel 3, as illustrated in FIG. 14. The lever 68 can rotate the push-down member 65 to lock the water sealing cover 61 in a pushed down state, so that the water sealed state can be maintained. As illustrated in FIG. 14, the position of the water sealing operation lever 68 is in the vicinity of the operation member 80 that moves the lid body 6. Therefore, at a location near the same end part, it is possible, at one location and within a short period of time, to move the lid body to open and close the charging port 5 and to prevent rainwater from entering when the charging port 5 is closed.

The bulk container 4 is also designed to sufficiently consider preventing rainwater from entering from the charging port 5 when the lid body 6 is closed. That is, in addition to the sealing mechanism 60 described above, a configuration similar to that of the bulk container 2 is adopted. For example, between the rear end edge part of each plate of the lid body 6 (the edge part on the side opposite to the side where the plates abut against each other) and the edge part of the charging port 5, the structure illustrated in the bottommost extracted drawing of FIG. 10 (the structure including the elastic packing 67) is provided. In addition, in the gap between both end edge parts of the charging port 5 in the length direction and the side edge part of the lid body 6 (the edge part along the movement direction of the lid body 6), the structure illustrated in the extracted drawings on the left and right sides in FIG. 9 (including the water intrusion prevention piece 69) is also adopted.

FIGS. 17A to 17D illustrate, in relation to the present invention, a configuration capable of improving the accumulation state of powdery or granular cargo within the container vessel 3. The configuration considers that, when a granular material is charged only at or in the vicinity of a center part of the charging port 5 that is longitudinally long, the granular material accumulates in a conical shape, and as a result, a large space in which no granular material exists may be formed in the front and rear portions of the container vessel 3. FIGS. 17A to 17D illustrate an example of the bulk container 4 described above. However, the configuration can be employed in any bulk container into which powdery or granular cargo is charged.

Figure 17A:
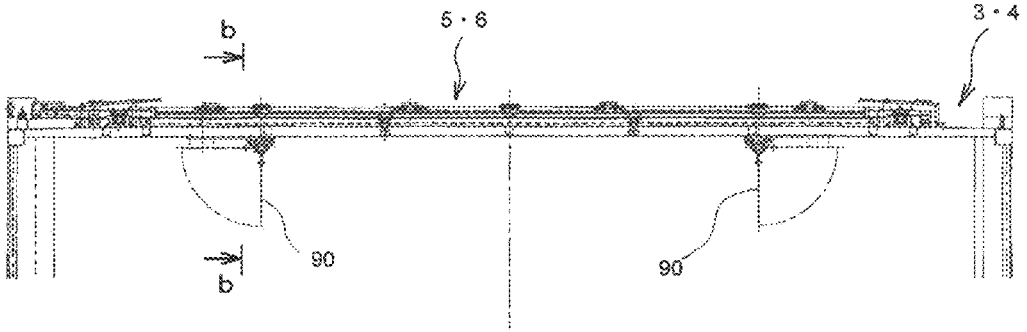
FIGS. 17A to 17D are views illustrating a partition plate 90 and the like provided inside a container vessel 3.
Figure 17B:
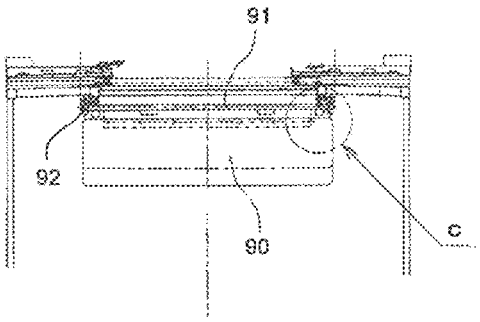

In the example of FIGS. 17A to 17D, as a means of improving the accumulation state of cargo, partition plates 90 that are swingable and illustrated in FIGS. 17A and 17B are provided in a suspended state at two locations in the upper portion inside the container vessel 3. As illustrated in FIG. 17B, each of the partition plates 90 is a flat plate extending in the width direction of the container vessel 3 below a support shaft 91 provided in the upper end part and includes a surface intersecting the length direction of the vessel 3. The support shaft 91 is swingably supported by bearings 92 provided at positions outside the charging port 5 in the width direction of the top portion.

Figure 17C:
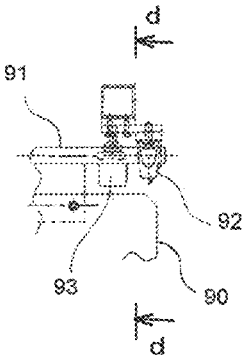
Figure 17D:
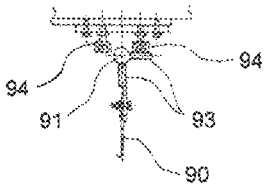

As illustrated in FIG. 17C, two projections 93 are provided on a side surface of the support shaft 91 at an interval of 90 degrees. Further, as illustrated in FIG. 17D, stoppers 94 are attached at respective positions such that stoppers 94 come into contact with the respective projections 93. By the action of the projections 93 and the stoppers 94, each of the two partition plates 90 can be swung and displaced within the range of 90 degrees, as illustrated in FIG. 17A. That is, a lower part of the partition plate 90 swings between a position in which the lower part faces vertically downward and a position in which the lower part of the partition plate 90 faces the side farther from the center part of the container vessel 3 and is placed horizontal.

If the partition plate 90 is provided in the upper part of the container vessel 3 as described above, by moving a vehicle on which the container vessel 3 is placed slightly forward and backward, and then suddenly stopping the vehicle, it is possible to smoothly move a part of the cargo in the powdery or granular state concentratedly accumulated at or in the vicinity of the center part of the container vessel 3, to the front and rear portions of the vessel 3. This is because, by the action of the two partition plates 90, which can be swung and displaced only away from the center part, the cargo in the powdery or particulate state is moved from the center part only toward the front and rear end parts, based on the inertial force generated when the vehicle suddenly stops. When the uneven accumulation state of the powdery or granular cargo can be improved in this manner, more powdery or granular cargo can be charged into the container vessel 3, so that it is possible to increase the capacity of the bulk container 4 for the cargo.

The invention claimed is:

1. A bulk container for receiving cargo in a powdery or granular state charged into a container vessel from a charging port provided in an upper part of the bulk container, wherein the charging port is covered with a lid body configured to move horizontally by a reciprocating movement to open and close the charging port, and the lid body performs the reciprocating movement in conjunction with a movement of an operation member provided in a side part of the container vessel.

2. The bulk container according to claim 1, wherein the charging port includes an opening having a rectangular shape that is long in a length direction of the container vessel, and the lid body is configured to move horizontally by a reciprocating movement in a width direction of the container vessel to open and close the charging port, and the lid body includes one plate configured to wholly cover the charging port, or includes two plates configured to wholly cover the charging port by bringing opposing edge parts of the two plates close to each other until the opposing edge parts abut against each other.

3. The bulk container according to claim 1, wherein the operation member is provided only on one side wall surface of the container vessel, guide members having a linear shape are arranged parallel to each other in a vicinity of both end parts of the charging port in the length direction, and each of the guide members is mounted with a moving block incorporating a rolling body so as to linearly move, and the lid body is attached to the moving block to be movable and the operation member is coupled to a part of the lid body, so that the lid body moves by the reciprocating movement in conjunction with the operation member.

4. The bulk container according to claim 3, wherein the lid body is fixedly attached to the moving block mounted to one of the guide members arranged in a vicinity of both end parts of the charging port, and is movably attached to the moving block mounted to the other one of the guide members.

5. The bulk container according to claim 3, wherein, when the charging port is closed by using the lid body, a tip end edge part of the lid body and an opening edge part of the charging port abut against each other, or opposing tip end edge parts of the two plates of the lid body abut against each other, and a metal member oriented upward is provided in each of the edge parts, a water sealing cover including an elastic packing on a lower surface of the water sealing cover is attached at or in a vicinity of one of the edge parts, and the water sealing cover is configured to be moved by an operation tool provided in a side part of the container vessel to press the elastic packing from above against the metal members oriented upward of both edge parts.

6. The bulk container according to claim 1, wherein a support rail is attached at a position spanning across the charging port to enable the reciprocating movement of the lid body and to support the lid body, a wheel configured to roll on the support rail is attached to a lower part of the lid body, and the support rail has a shape in which a center part protrudes upward.

7. The bulk container according to claim 1, comprising, at a position directly below the charging port in the container vessel, an inclined plate or an impeller configured to change a falling direction of the cargo in the powdery or granular state being charged.

8. The bulk container according to claim 1, wherein the operation member is provided not in the side part of the container vessel, but at a position in a top portion of the container vessel close to any one side part.

9. The bulk container according to claim 1, wherein the operation member is provided in the side part of the container vessel at a position above a discharging port used for discharging the cargo, or in the top portion of the container vessel at a position close to a side part including the discharging port.

10. The bulk container according to claim 1, wherein partition plates are provided at a plurality of locations in an upper part of the inside of the container vessel, excluding a center part of the container vessel in the length direction, each of the partition plates includes a surface intersecting the length direction of the container vessel, and an upper end part of each of the partition plates is supported, and each of the partition plates is swingably provided and configured to displace only between a position in which a lower part of the partition plate faces vertically downward and a position when the lower part has been swung in a direction from the center part to an end part in the length direction.

* * * * *